US007348726B2

(12) United States Patent
Terao et al.

(10) Patent No.: US 7,348,726 B2
(45) Date of Patent: Mar. 25, 2008

(54) PLASMA DISPLAY PANEL AND MANUFACTURING METHOD THEREOF WHERE ADDRESS ELECTRODES ARE FORMED BY DEPOSITING A LIQUID IN CONCAVE GROOVES ARRANGED IN A SUBSTRATE

(75) Inventors: Yoshitaka Terao, Yokohama (JP); Yukika Yamada, Yokohama (JP)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 516 days.

(21) Appl. No.: 10/629,793

(22) Filed: Jul. 30, 2003

(65) Prior Publication Data

US 2004/0130265 A1 Jul. 8, 2004

(30) Foreign Application Priority Data

Aug. 2, 2002 (JP) ..... 2002-226620
Aug. 2, 2002 (JP) ..... 2002-226621
Jan. 14, 2003 (KR) ..... 10-2003-0002410
Jan. 14, 2003 (KR) ..... 10-2003-0002411

(51) Int. Cl.
*H01J 17/49* (2006.01)

(52) U.S. Cl. ..... 313/582; 445/23; 313/587

(58) Field of Classification Search ..... 313/582–587; 345/60; 445/23–25; 315/169.1, 169.3
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing, no month.

*Primary Examiner*—Joseph Williams
(74) *Attorney, Agent, or Firm*—Robert E. Bushnell, Esq.

(57) ABSTRACT

A plasma display panel includes first and second transparent substrates provided opposing one another; first electrodes provided in parallel on the first transparent substrate, second electrodes provided in parallel on the second transparent substrate on a surface of the same opposing the first transparent substrate, the second electrodes being formed perpendicular to the first electrodes, and barrier ribs that form concave sections between the second electrodes and define discharge cells together with the concave sections. The second electrodes are formed by keeping still conductive liquid material that includes conductive particles, and allowing precipitated conductive particles to join by a heat treating process. In another aspect, at least one protrusion is formed in the each of the concave sections to divide the concave sections into a plurality of sections.

23 Claims, 21 Drawing Sheets

U.S. PATENT DOCUMENTS

| | | | | |
|---|---|---|---|---|
| 5,786,794 | A | 7/1998 | Kishi et al. | |
| 5,951,350 | A * | 9/1999 | Aoki et al. | 445/24 |
| 5,952,782 | A | 9/1999 | Nanto | |
| RE37,444 | E | 11/2001 | Kanazawa | |
| 6,437,507 | B2 * | 8/2002 | Ha | 313/587 |
| 6,630,916 | B1 | 10/2003 | Shinoda | |
| 6,707,436 | B2 | 3/2004 | Setoguchi et al. | |

FOREIGN PATENT DOCUMENTS

| | | |
|---|---|---|
| JP | 06-251714 | 9/1994 |
| JP | 09-274859 | 10/1997 |
| JP | 09-283032 | 10/1997 |
| JP | 2845183 | 10/1998 |
| JP | 11-096911 | 4/1999 |
| JP | 2917279 | 4/1999 |
| JP | 11-273557 | 10/1999 |
| JP | 2001-043804 | 2/2001 |
| JP | 2001-060434 | 3/2001 |
| JP | 2001-325888 | 11/2001 |
| KR | 10-0303907 | 7/2001 |

* cited by examiner

PLASMA DISPLAY PANEL AND MANUFACTURING METHOD THEREOF WHERE ADDRESS ELECTRODES ARE FORMED BY DEPOSITING A LIQUID IN CONCAVE GROOVES ARRANGED IN A SUBSTRATE

CLAIM OF PRIORITY

This application makes reference to, incorporates the same herein, and claims all benefits accruing under 35 U.S.C. §119 from an application for PLASMA DISPLAY PANEL AND MANUFACTURING METHOD THEREOF earlier filed in the Korean Intellectual Property Office on 14 Jan. 2003 and there duly assigned Serial Nos. 2003-2410 and 2003-2411 and in the Japanese Intellectual Property Office on 2 Aug. 2002 and there duly assigned Serial Nos. 2002-226620 and 2002-226621.

BACKGROUND OF THE INVENTION

1. Field of the Invention

The present invention relates to a plasma display panel and a manufacturing method thereof. More particularly, the present invention relates to a plasma display panel and a manufacturing method thereof, in which display spots of pixel regions are made small such that image quality is improved, the structure thereof is made simple, manufacturing processes are minimized manufacturing equipment expenses are reduced, and the cost of the finished product is significantly decreased. The present invention relates also to a plasma display panel and a manufacturing method, in which the plasma display panel is suitable when requiring dual driving in addition to high precision and high brightness.

2. Description of the Related Art

The plasma display panel (PDP) is receiving much attention as a result of its ability to be made to large sizes and provide high picture quality. The PDP typically includes a pair of transparent substrates provided opposing one another, a plurality of first electrodes formed in a striped pattern on an Inner surface of one of the two substrates, a plurality of second electrodes formed in a striped pattern on an inner surface of the other of the two substrates, barrier ribs formed between the two substrates, and discharge cells defined by concave sections formed by the barrier ribs. The PDP with such a structure may realize the natural display of gray scale, has good color realization and responsiveness, and can be made to large sizes at a relatively low cost.

There have recently been disclosed plasma display panels, in which the address electrodes are divided into two sections, and fully distinct data signals are input to each divided address electrode in accordance with high precision, high brightness, and dual driving requirements.

We have discovered that what is needed is an improved method for manufacturing and an improved PDP design that obtains excellent image quality but is easy and inexpensive to produce for both cases where the address electrodes are divided and when the address electrodes are not divided.

SUMMARY OF THE INVENTION

It therefore an object of the present invention to provide an improved display panel for both mono drive and dual drive.

It is also an object of the present invention to provide an improved method of manufacture for a plasma display panel for both mono drive and dual drive.

It is also an object of the present invention to provide a plasma display panel and a method for manufacturing the same, in which a high image quality of a display surface is realized, a simple structure is realized, minimization of production processes is realized, reduction in manufacturing equipment costs is realized, and overall cost of the plasma display panel are also realized.

It is another object of the present invention to provide a plasma display panel and a method for manufacturing the same that has quick responses when requiring a dual drive in addition to high precision and high brightness of image.

In a first embodiment of the present invention pertains to a mono drive PDP and method for manufacture of the same. This plasma display panel is made up of a first and second transparent substrates opposing one another, a plurality of first electrodes provided in parallel on the first transparent substrate, a plurality of second electrodes provided in parallel on the second transparent substrate on a surface of the same opposing the first transparent substrate, the second electrodes being formed perpendicular to the first electrodes; and a plurality of barrier ribs with concave sections there between, the concave sections and the barrier ribs being formed in the second transparent substrate, the second electrodes formed at the bottom of the concave portions, the concave portions with the second electrodes defining discharge cells together with the concave sections.

Instead of depositing a silver sheet, patterning and developing photoresist and then etching to form the second electrodes, a key feature of the present invention is a much simpler and less expensive method of forming the second electrodes. In the present invention, the second electrodes are formed by keeping still conductive liquid material poured into the concave sections. The conductive liquid is made up of conductive particles. A supply apparatus may be used to supply the conductive liquid material to fill the concave sections with the conductive liquid material. When allowed to settle, the conductive particles are gathered together at the bottoms of the concave portions. The conductive particles are then joined into the second electrode by a heat treating process. The resultant second electrodes structure is an electrode contacting a bottom of the concave sections so that the shape of the second electrodes conforms to and matches that of the concave sections, where the second electrodes are disposed on a surface opposing the first electrodes.

In the plasma display panel structured as in the above, differences in a spacing between the first and second electrodes in plasma generation regions is uniform, resulting in minimal differences in plasma discharge. Hence, display spots in the pixel regions are significantly reduced such that overall display quality is improved.

It is preferable that a distance from a predetermined location of the concave sections to a surface of the second electrodes is uniform. Therefore, with the second electrode design of the present invention, the spacing between the first and second electrodes is kept substantially uniform such that the differences in plasma discharge is made extremely small. Again, display spots in the pixel regions are significantly reduced such that overall display quality is improved.

In addition to the structural change in the second electrodes and the method for forming the second electrodes, another feature of the present invention, a liquid repellent layer is formed on upper ends of side walls of the concave sections between the concave portions. Preferably, this liquid repelling layer is silicon dioxide. This liquid repelling layer insures that the liquid with the conductive particles does not gather on the tops of the ridges between the concave portions when the liquid is poured into the concave portions. Because of this structural difference, the method of making the PDP is altered in that the method further includes forming on the first surface of the transparent substrate a liquid repellent layer having liquid repellency with respect to the conductive liquid material. The formation of the liquid repellent layer may be performed before forming the concave sections.

In a second embodiment of the present invention, a structure similar to the first embodiment is formed. However in the second embodiment, at least one protrusion is formed in the each of the concave sections to divide the concave sections into a plurality of sections for dual or other plurality drive PDP's. The protrusion serves to electrically separate the second electrodes in adjacent concave portions. The height of the protrusion is 20% to 100% the height of the concave sections.

A method for manufacturing a-plasma display panel according to the second embodiment of the present invention with the protrusions in the concave section includes the steps of forming a resist film having at least one narrow section or cutoff section for forming at least one protrusion that divides concave sections into a plurality of sections, the resist film being formed on a first surface of a second transparent substrate, forming the concave sections and the protrusions on the first surface of the transparent substrate using the resist film, supplying a conductive liquid material including conductive particles to the concave sections, and keeping still the conductive liquid material to precipitate the conductive particles included therein, and heat treating the conductive particles to form second electrodes in each section of the concave sections. It is to be appreciated that the method of making the first transparent substrate may be the same as in the first embodiment.

Using the resist film, the concave sections and the protrusions, which divide the concave sections into a plurality of sections, are formed. A depth of areas etched using the narrow sections as a mask is less than a depth of other areas etched using the mask, thereby resulting in the protrusions that are formed to a lesser depth than the concave sections.

Next, as described above, the conductive liquid material including conductive particles is supplied to the concave sections, then the conductive liquid material is kept still to precipitate the conductive particles included therein. As a result, the conductive particles are not accumulated on the protrusions or the ribs, and the conductive liquid is only located in the sections concave sections divided by the protrusions. Therefore, relatively simple processes are used (compared to the photolithography process) to form the second electrodes in each of the regions of the concave sections such that overall manufacture is made simple and production costs minimized. The manufacturing equipment needed is also simpler than that using photolithography to further reduce costs.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 17:
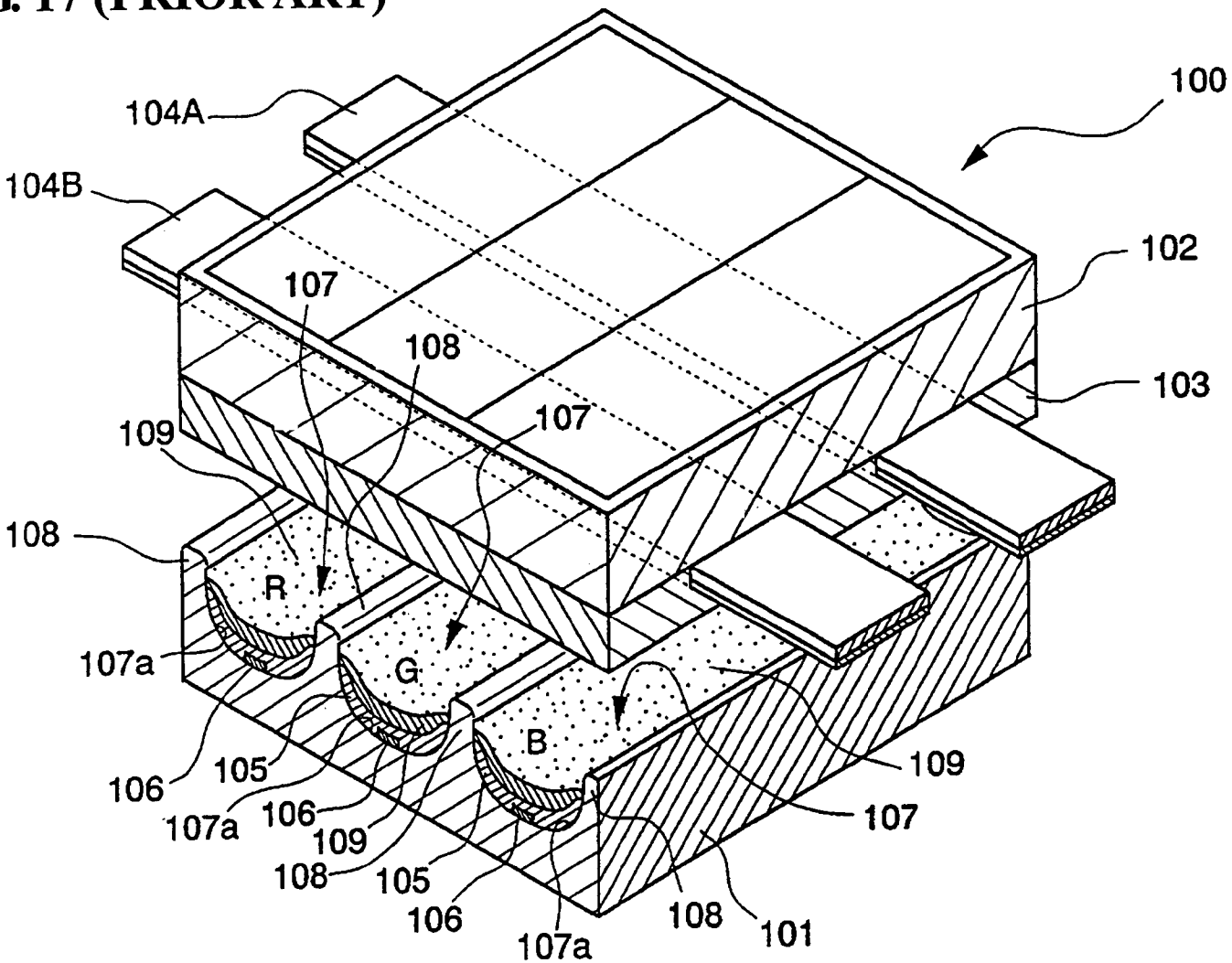
FIG. 17 (PRIOR ART)
FIG. 17 is a partial exploded perspective view of an AC plasma display panel.

Turning to the drawings, FIG. 17 illustrates an exploded perspective view of an AC PDP. As illustrated in FIG. 17, the AC PDP 100 includes rear and front glass substrates (transparent substrates) 101 and 102, respectively, opposing one another to define an exterior of the AC PDP 100. Formed on an inner surface of the rearglass substrate 101 opposing the front glass substrate 102 are a plurality of scanning electrodes (transparent electrodes) 104A and sustain electrodes 104B, which are made of a transparent conductive material such as Indium Tin Oxide (ITO) and $SnO_2$. The scanning electrodes 104A and the sustain electrodes 104B are provided in parallel, in a striped pattern, and an alternating manner. A transparent dielectric layer 103 covers the scanning electrodes 104A and the sustain electrodes 104B. A protection film (not illustrated) made of a material such as MgO is formed covering the dielectric layer 103.

Discharge cells 107, inside of which gas discharge occurs, are formed on an inner surface of the front glass substrate 101 opposing the rear glass substrate 102. A plurality of barrier ribs 108 having a predetermined height (d) are formed between adjacent discharge cells 107 in a striped pattern along a direction that is orthogonal to the scanning electrodes 104A and the sustain electrodes 104B. Concave sections 107*a* are formed between the barrier ribs 108, and the discharge cells 107 are defined by the concave sections 107*a* and are bounded by the barrier ribs 108. The barrier ribs 108 are integrally formed to the front glass substrate 101.

An address electrode 106 is formed in each of the concave sections 107*a*. The address electrodes 106 are therefore formed in a striped pattern and are orthogonal to the scanning electrodes 104A and the sustain electrodes 104B. The address electrodes 106 are covered by dielectric layers 105 that have a high reflexibility. Further, phosphor layers 109, each made of red, green, or blue phosphors are formed over the dielectric layers 105, that is, one of the phosphor layers 109 is formed over each dielectric layer 105.

The rear and front glass substrates 101 and 102 structured in this manner are provided opposing one another as described above. In a state where a compound gas such as Ne—Xe and He—Xe that uses Xe resonance radiation is placed in each of the discharge cells 107, peripheries between the rear and front glass substrates 101 and 102 are sealed using a sealant glass or other such means.

Conductive material such as silver (Ag) paste or a Cr—Cu—Cr layered film is used for the address electrodes 106. Alternatively, the address electrodes 106 are formed using Ag sheets instead of Ag paste.

In the plasma display panel structured as in FIG. 17, one ends of each the scanning electrodes 104A, the sustain electrodes 104B, and the address electrodes 106 are extended from a display region and voltages are selectively applied to terminals connected to these elements. As a result, discharge selectively occurs within the discharge cells 107 between the scanning electrodes 104A, the sustain electrodes 104B, and the address electrodes 106. As a result of such discharge, the phosphor layers 109 in the discharge cells 107 emit an excitation light for display to the outside. An illumination surface is realized by a surface portion of the phosphor layers 109 facing the discharge cells 107.

For a method to form the barrier ribs 108 in the rear glass substrate 101, a method is used in which areas where the discharge cells 107 are to be formed are removed by a sandblasting process, or in which the rear glass substrate 101 is heated to soften the same, after which a frame having the inverted pattern of the barrier ribs 108 is pressed against the rear glass substrate 101 to thereby form the barrier ribs 108. In either case, the address electrodes 106, the dielectric layers 105, and the phosphor layers 109 are formed only after the completion of the barrier ribs 108.

A method for manufacturing the plasma display panel of FIG. 17 will now be described. First, using a thin film formation technique such as a deposition or a sputtering method, a conductive material such as ITO or $SnO_2$ is grown over the entire inner surface of the front glass substrate 102. The conductive material is then patterned by a photolithography process to thereby form the scanning electrodes 104A and the sustain electrodes 104B in a striped pattern.

Next, a dielectric material is deposited on the front glass substrate 102 covering the scanning electrodes 104A and the sustain electrodes 104B, after which sintering is performed at a predetermined temperature such that the transparent dielectric layer 103 is formed. Further, a protection film material having as a main component MgO is deposited on the dielectric layer 103 then sintered at a predetermined temperature to thereby form the transparent protection film (not illustrated).

Figure 18A:
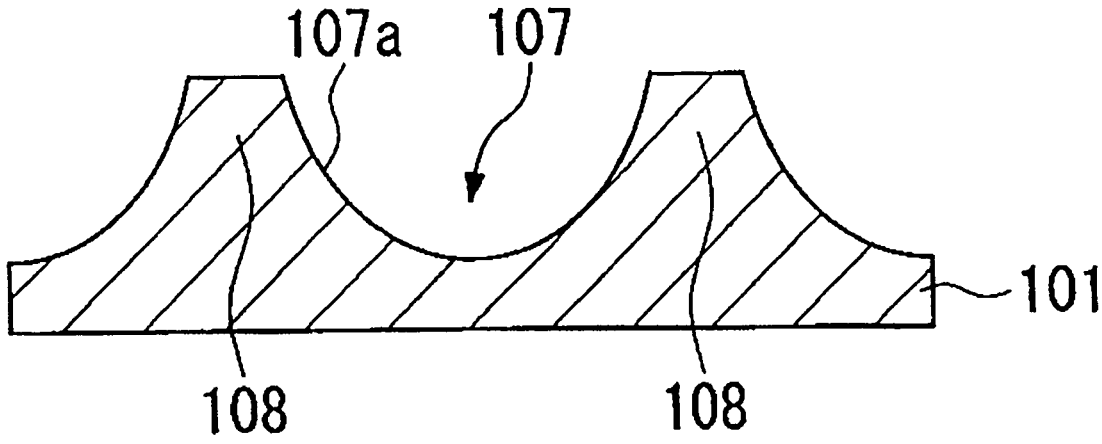
FIG. 18A (PRIOR ART)
FIGS. 18A to 18D are partial sectional views showing sequential steps in manufacturing a plasma display panel of FIG. 17.

With respect to the rear glass substrate 101, referring to FIG. 18A, the concave sections 107*a* are formed to predetermined dimensions by cutting away the inner surface of the front glass substrate 101 by a sandblasting process. Portions of the rear glass substrate 101 not cut away and on both sides of each of the concave sections 107*a* form the barrier ribs 108. The barrier ribs 108 and the concave sections 107*a* define the discharge cells 107.

Figure 18B:
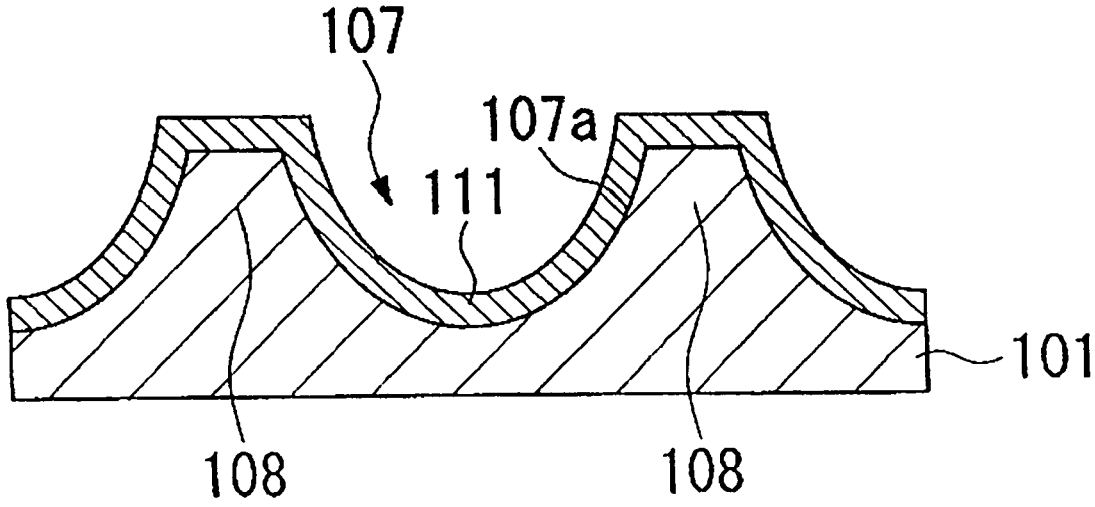
FIG. 18B (PRIOR ART)
Figure 18C:
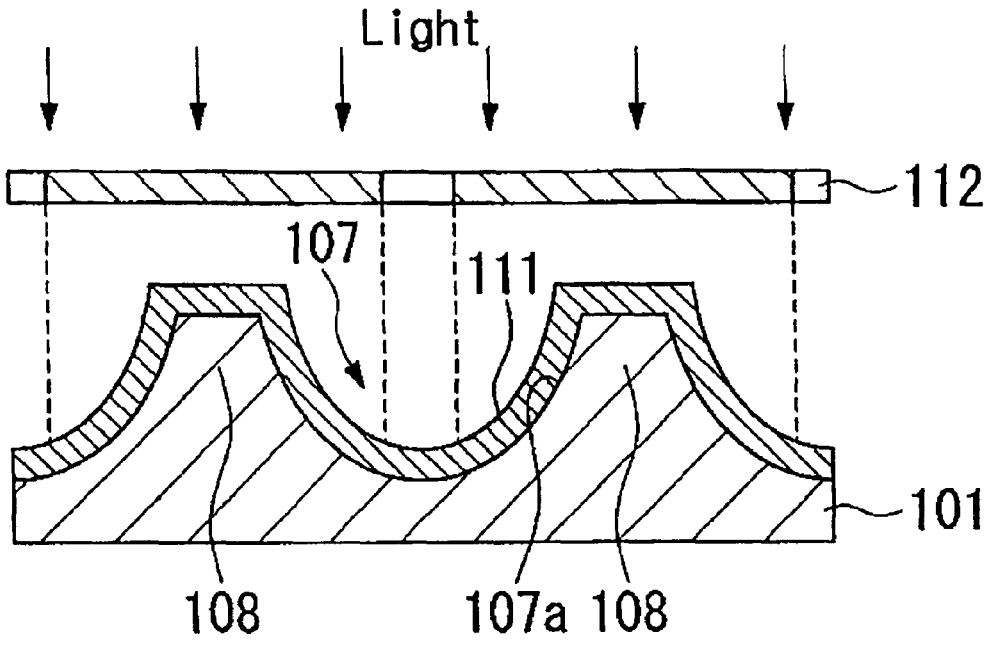
FIG. 18C (PRIOR ART)
Figure 18D:
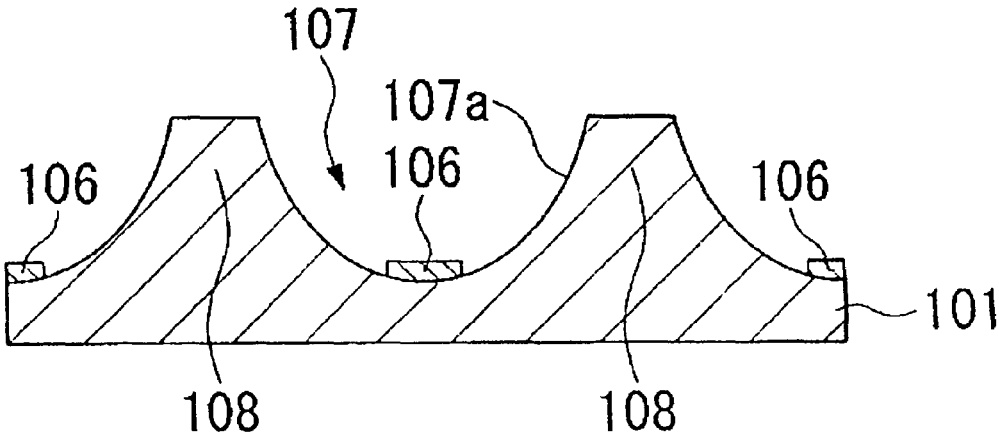
FIG. 18D (PRIOR ART)

Next, with reference to FIG. 18B, a silver sheet (electrode sheets) 111 is pressed onto the entire inner surface of the rear glass substrate 101 using a pressing roller such that the silver sheet 111 is formed corresponding to the shape of the concave sections 107*a* and the barrier ribs 108. Following this procedure, with reference to FIG. 18C, the silver sheet 111 is patterned by a photolithography process and by using a photo mask 112 of a predetermined pattern, thereby resulting in the address electrodes 106 of a striped pattern as illustrated in FIG. 18D.

Figure 19:
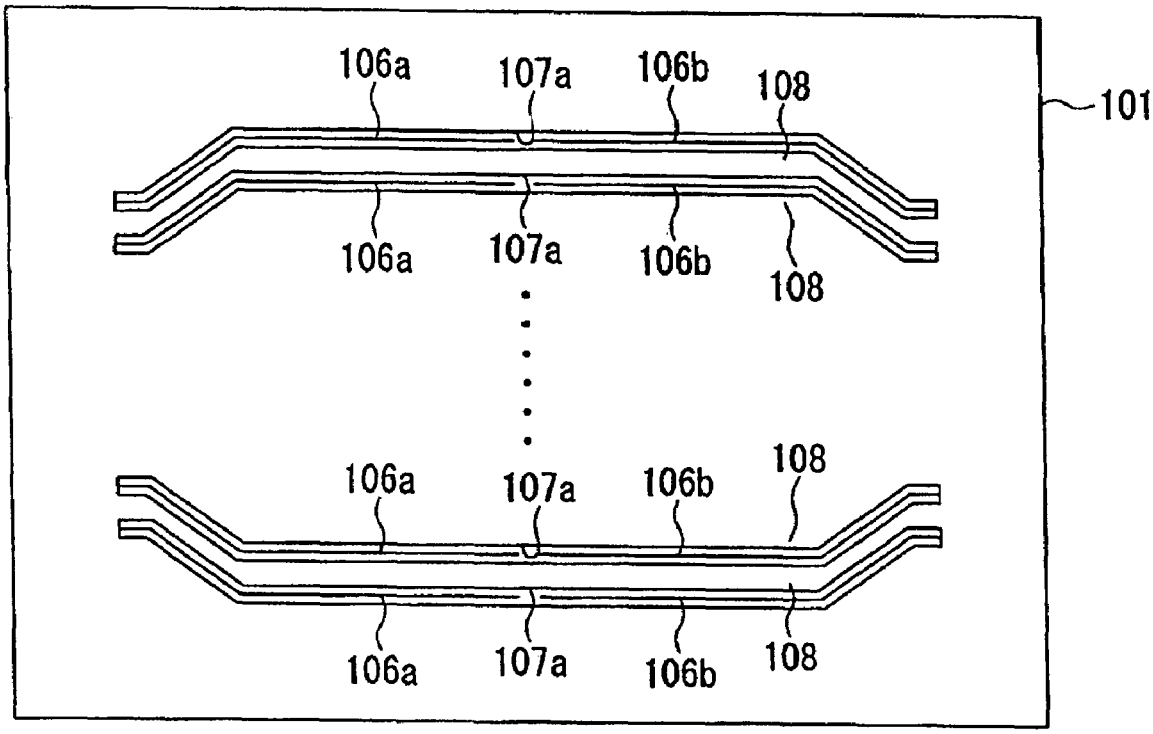
FIG. 19 (PRIOR ART)
FIG. 19 is a plan view showing an example of an AC-PDP electrode pattern for an AC plasma display panel, in which address electrodes are divided into two sections.

FIG. 19 is a plan view showing an example of an AC-PDP dual drive electrode pattern, in which the address electrodes are separated into two sections for a dual drive PDP. As illustrated in FIG. 19, address electrodes 106*a* and 106*b* that have been divided into two sections at a center portion thereof are formed in the concave sections 107*a* in a striped pattern and in a state orthogonal to the scanning electrodes 104A and the sustain electrodes 104B. The address electrodes 106*a* and 106*b* are covered with the dielectric layers 105, which have a high reflexibility.

Subsequently, using a screen printing process or a roll coating process, a dielectric material having a high reflexibility is deposited on the barrier ribs 108 and the concave sections 107*a*, after which sintering is performed at a predetermined temperature. The dielectric layers 105 are formed through this process. Next, red, green, and blue phosphor materials are deposited over the dielectric layers 105. The phosphor materials, which come in a paste, are dried and sintered to thereby form the phosphor layers 109.

The rear and front glass substrates 101 and 102 structured in this manner are provided opposing one another, then a compound gas such as Ne—Xe and He—Xe is injected into the discharge cells 107, after which the rear and front glass substrates 101 and 102 are sealed. This completes the plasma display panel 100.

However, in the plasma display panel of FIGS. 17 and 19, since the address electrodes 106 are formed by patterning a conductive material such as silver sheets, silver paste, and a Cr—Cu—Cr layered film using a photolithography process, overall costs are increased by the expense of the conductive material to thereby result in raising unit costs of the plasma display panels. Further, if photolithography is used, the equipment required is expensive and manufacturing processes are slowed. In addition, it is difficult to respond quickly in a plasma display panel that requires a dual drive in addition to-high precision and high brightness.

Figure 1:
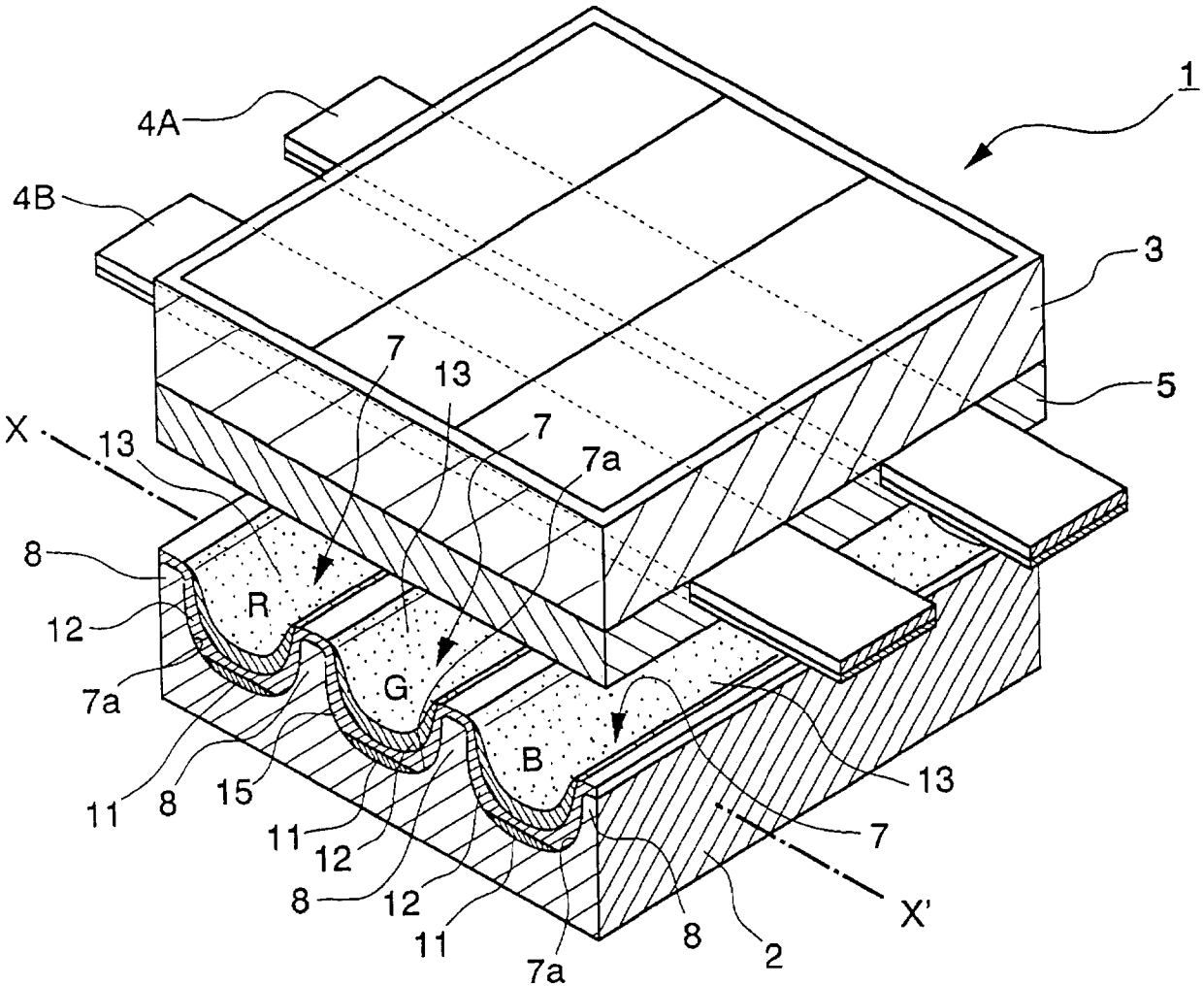
FIG. 1 is a partial exploded perspective view of a plasma display panel according to a first embodiment of the present invention.

The preferred embodiments of the present invention will now be described in detail with reference to the accompanying drawings. Turning to FIG. 1, FIG. 1 is a partial exploded perspective view of a plasma display panel according to a first embodiment of the present invention. As illustrated in FIG. 1, a plasma display panel (PDP) 1 includes a rear glass substrate 2 and a front glass substrate 3 provided opposing one another to define an exterior of the PDP 1. Scanning electrodes (first electrodes) 4A and sustain electrodes 4B made of a transparent conductive material such as ITO and $SnO_2$ are formed in parallel and in a striped pattern on an inner surface of the front glass substrate 3 facing the rear glass substrate 2. A transparent dielectric layer,5 is formed on the front glass substrate 3 covering the scanning electrodes 4A and the sustain electrodes 4B, and a transparent protection layer (not illustrated) is formed on the front glass substrate 3 covering the dielectric layer 5. The scanning electrodes 4A and the sustain electrodes 4B are provided as described above in an alternating configuration.

Discharge cells 7, inside of which gas discharge occurs, are formed on an inner surface of the rear glass substrate 2 opposing the front glass substrate 3. That is, a plurality of barrier ribs 8 having a predetermined height is formed in a striped pattern along a direction that is orthogonal to the scanning electrodes 4A and the sustain electrodes 4B. Concave sections 7*a* are formed between the barrier ribs 8, and the discharge cells 7 are defined by the concave sections 7*a* and the barrier ribs 8. It is preferable to form the barrier ribs 8 integrally to the rear glass substrate 2 as illustrated in FIG. 1 for ease of manufacture. However, the barrier ribs 8 may be formed as separate units from the rear glass substrate 2.

An address electrode (second electrode) 11 is formed as strips on a lowermost surface of each of the concave sections 7*a* to thereby substantially perpendicularly intersect the scanning electrodes 4A and the sustain electrodes 4B. A dielectric layer 12 having a high reflexibility is formed covering the address electrodes 11. Further, phosphor layers 13, each made of red, green, or blue phosphors are formed over the dielectric layer 12, that is, one of the phosphor layers 13 is formed over dielectric layer 12 within each concave section 7*a*.

The address electrodes 11 are formed by filling the concave sections 7*a* with a slurry (conductive liquid material), which includes at least conductive particles, glass frit, water, a binder resin, and a dispersing agent. Next, the slurry is kept still for a predetermined time to precipitate the conductive particles, then a heat treating process is performed at a predetermined temperature and for a predetermined time such that the precipitated conductive particles join together to form the address electrodes 11.

For the conductive particles, silver particles or silver compound particles having an average particle diameter of 0.05~5.0 μm, or preferably 0.1~2.0 μm, may be used. Further, for the glass flit, a substance that does not affect the characteristics of electrodes should be used. For example, borosilicatelead glass, borosilicatezinc glass, or borosilicatebismuth glass having an average particle diameter of 0.1~5.0 μm, or preferably 0.1~2.0 μm, is used.

The rear and front glass substrates 2 and 3 structured in this manner are provided opposing one another, then in a state where a compound gas such as Ne—Xe and He—Xe, which use Xe resonance radiation of 147 nm, is provided in each of the discharge cells 7, the rear and front glass substrates 2 and 3 are sealed using a sealant glass around peripheries of the opposing surfaces.

In the PDP 1 structured as in the above, one ends of each the scanning electrodes 4A, the sustain electrodes 4B, and the address electrodes 1 are protruded outwardly from the glass substrates 22 and 3, and voltages are selectively applied to terminals connected to these elements. Accordingly, discharge occurs in the discharge cells 7 between the scanning electrodes 4A, and the sustain electrodes 4B and the address electrodes 11. By such discharge, excitation light is outwardly emitted (i.e., away from the PDP 1) from the phosphor layers 13.

A method for manufacturing the PDP 1 of the first embodiment of the present invention will; now be described. Turning to FIGS. 2A to 2F, FIGS. 2A to 2F illustrate partial sectional views showing sequential steps in forming the concave sections 7*a* in the method for manufacturing the PDP 1 according to the first embodiment of the present invention, and are taken along line X-X' of FIG. 1. FIGS. 3A to 3C are partial sectional views showing sequential steps in forming the address electrodes 11 in the method for manufacturing the PDP 1 according to the first embodiment of the present invention, and are taken along line X-X' of FIG. 1.

Figure 2A:
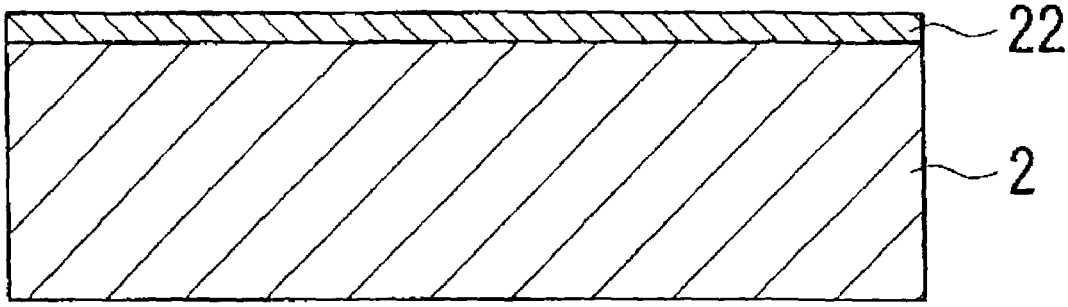
FIGS. 2A to 2F are partial sectional views showing sequential steps in forming concave sections in a manufacturing method of a plasma display panel according to a first embodiment of the present invention.
Figure 3A:
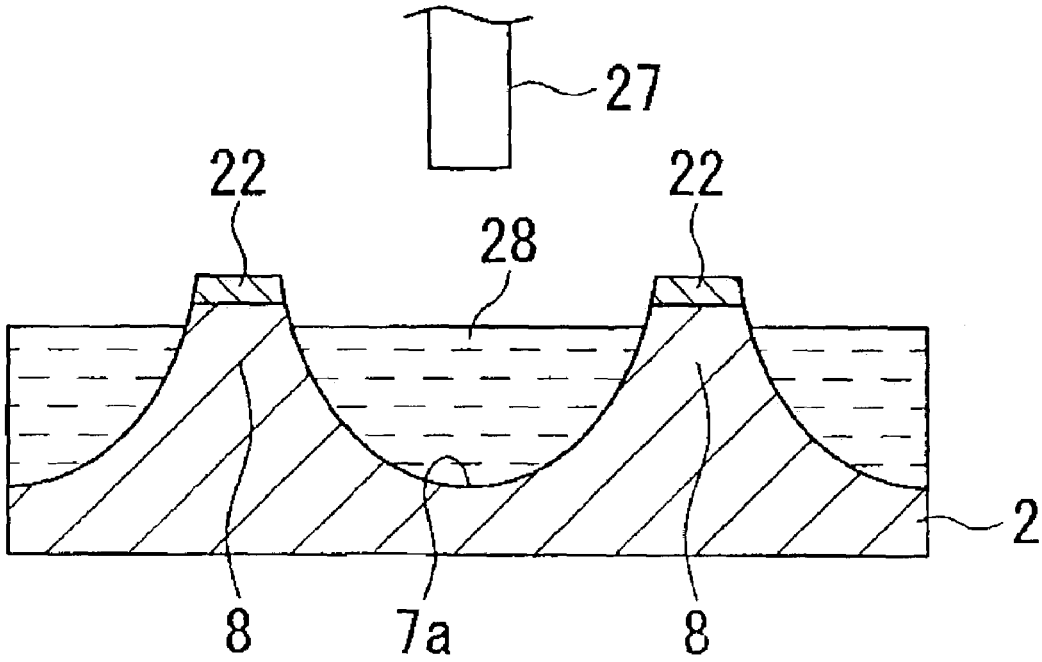
FIGS. 3A to 3C are partial sectional views showing sequential steps in forming address electrodes in a method of manufacturing a plasma display panel according to a first embodiment of the present invention.
Figure 3B:
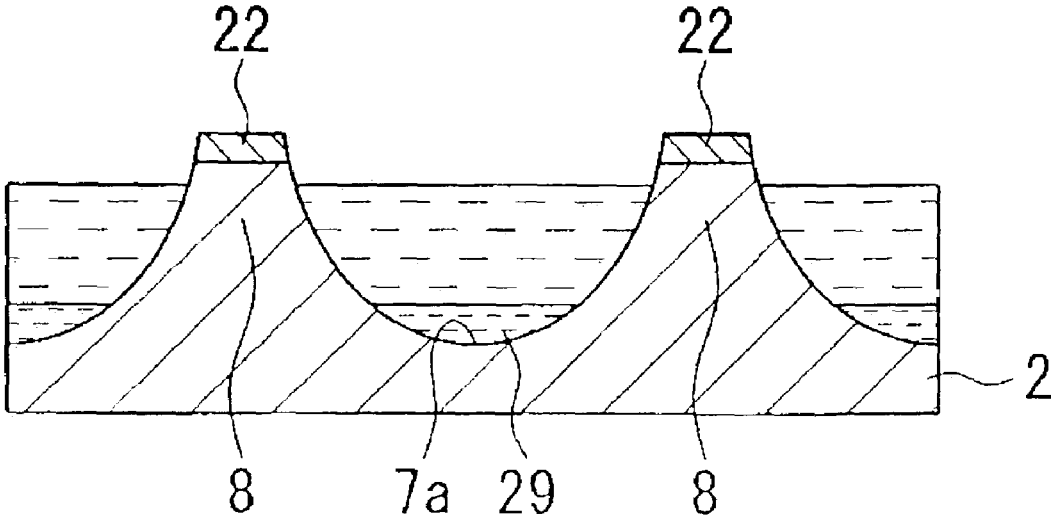
Figure 3C:
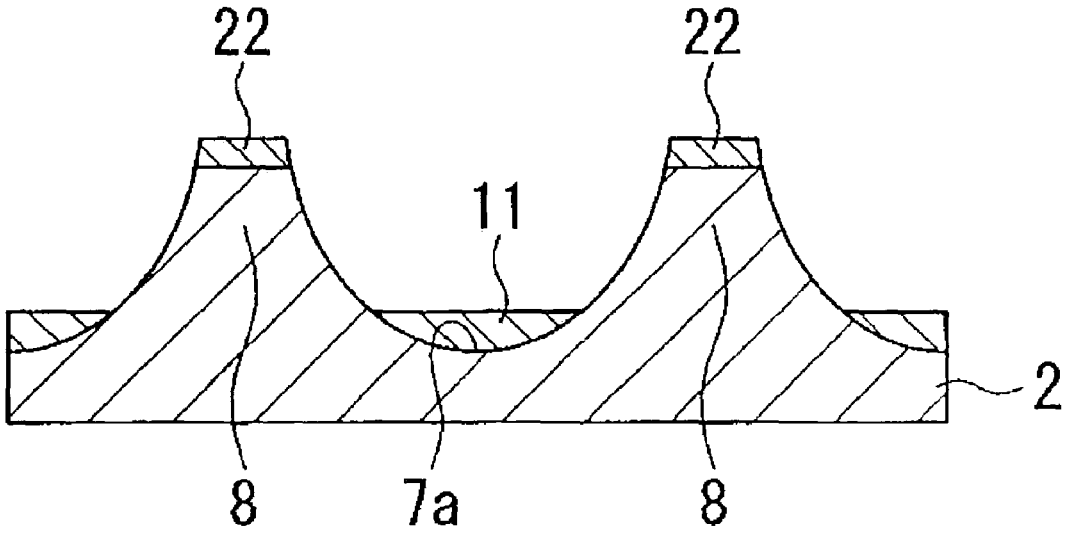

First, with reference to FIG. 2A, after a glass substrate (transparent substrate) 2, which is made of a substance such as soda lime, is cleaned using an organic solvent then dried, a silicon dioxide film (liquid repellent layer) 22 having repellency (liquid repellency) with respect to the slurry (conductive liquid material) as described above is formed over an entire surface of the glass substrate 2. The silicon dioxide film 22 is formed by depositing an alkoxide such as tetraethylorthosilicate ($Si(OC_2H_5)_4$), then by heat treating the alkoxide at a predetermined temperature.

Figure 2B:
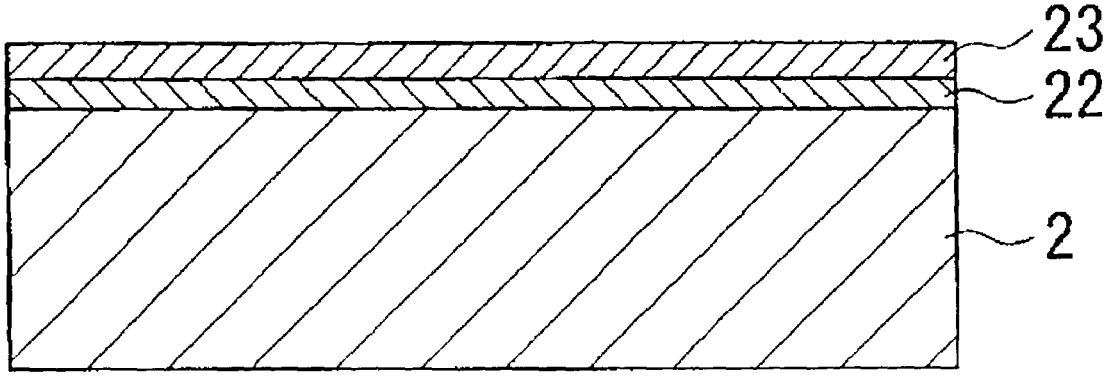

Subsequently, with reference to FIG. 2B, a photoresist (resist film) 23 is formed over an entire surface of the silicon dioxide film 22. A material that is difficult to cut by a sandblasting process is used for the photoresist 23, and it is preferable to use a dry film resist that may be easily formed by a compression process.

Figure 2C:
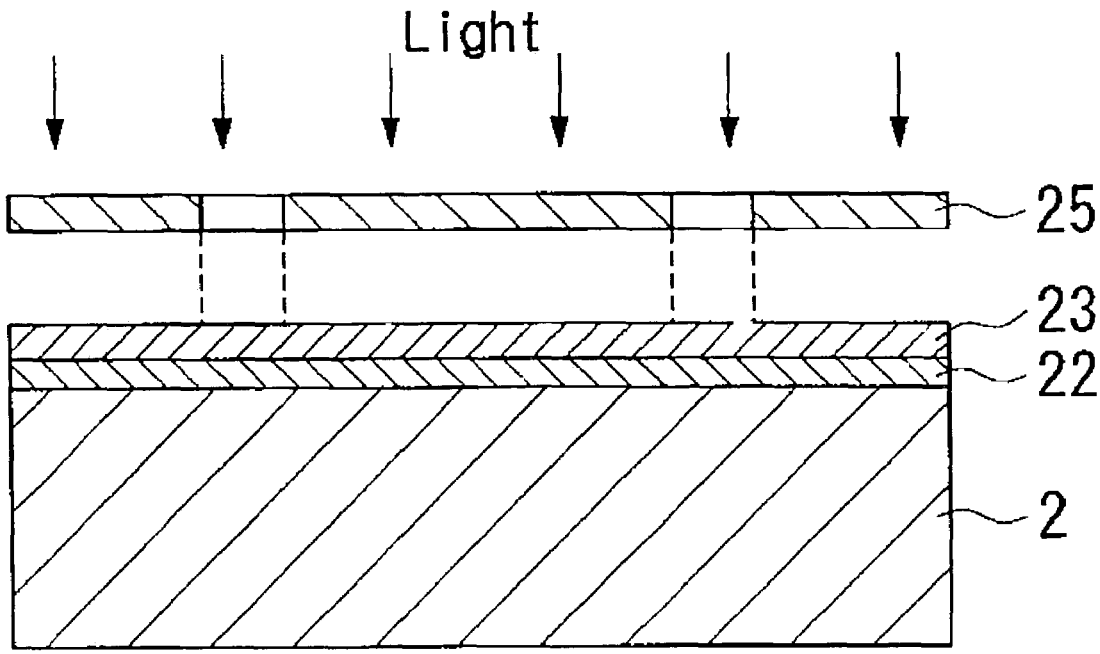
Figure 2D:
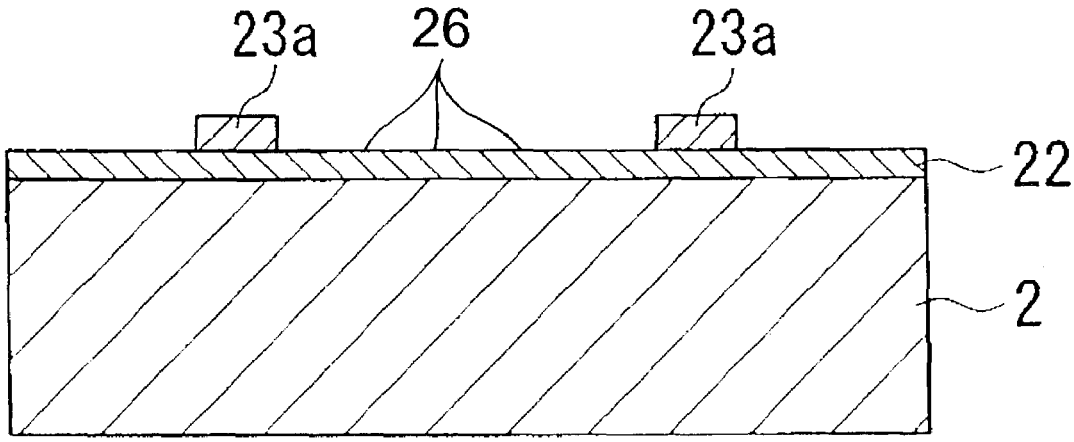

Following the formation of the photoresist 23, with reference to FIG. 2C, a photomask 25 is provided over the photoresist 23 having a pattern corresponding to a shape and location of the barrier ribs 8. The photoresist 23 is then, exposed through openings of the photomask 25, then developed such that photoresist sections 23*a* are formed having a shape of the barrier ribs 8 and corresponding to a pattern of the same as illustrated in FIG. 2D.

Figure 2E:
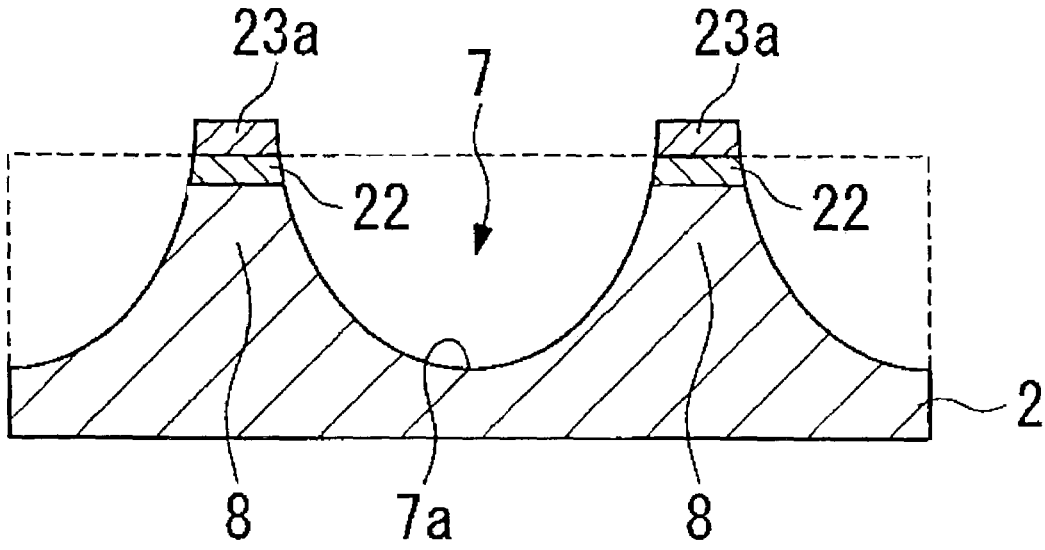
Figure 2F:
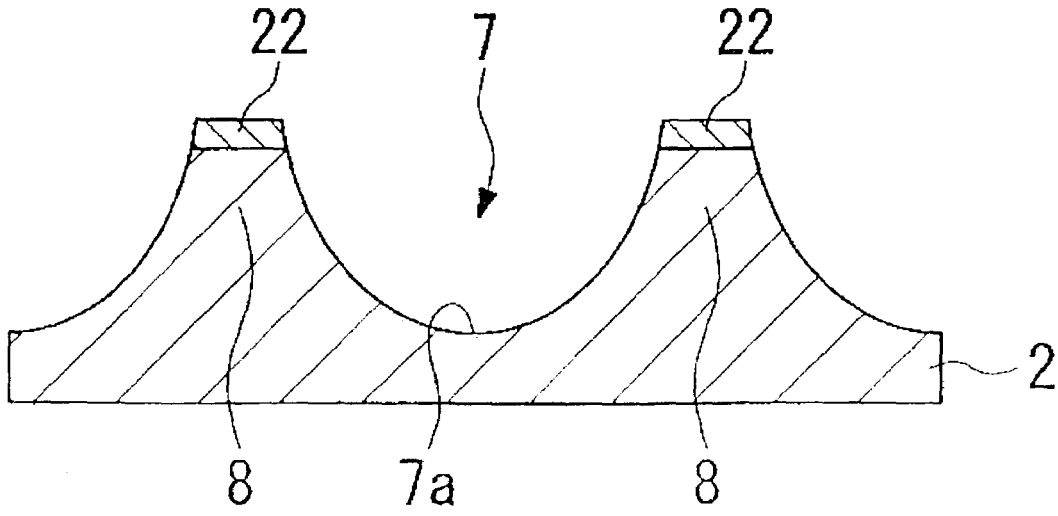

Next, a sandblasting process is used to etch the silicon dioxide film 22 and the glass substrate 2 at middle sections 26 between the photoresist sections 23*a*. Accordingly, the discharge cells 7, which are defined by the concave sections 7*a* and the barrier ribs 8, are formed as illustrated in FIG. 2E. Since the silicon dioxide film 22 is etched where it is exposed in the middle sections 26, the silicon dioxide film 22 is left remaining only on upper surfaces of the barrier ribs 8 after this process is formed. The concave sections 7*a* formed by etching have a depressed surface with a depth (d) of 100~300 μm.

In the sandblasting process, since the glass substrate 2 is made of a material such as soda lime glass as described above, a silundum (SiC) powder or alumina ($Al_2O_3$) powder, which provide a sufficient cutting force, is preferably used. To better suit the use of silundum powder or alumina powder, it is preferable that a material that has elasticity even after solidifying be used for the photoresist sections 23*a*. It is also preferable to use the dry film resist on the basis of the degree of resistance to cutting by sandblasting and adhesivity with respect to the silicon dioxide film 22.

Subsequently, after the photoresist sections 23*a* are removed-and drying is performed, the discharge cells 7 that are defined by the concave sections 7*a* and the barrier ribs 8 are formed. The glass substrate 2 is therefore formed, in which the silicon dioxide films 22 are formed on the distal surfaces of the barrier ribs 8.

Referring now to FIG. 3A, using a dispenser (supply apparatus) 27, a water-based slurry (conductive liquid material) 28 is filled into the concave sections 7*a* of the glass substrate 2. Instead of the dispenser 27, an inkjet nozzle, spray nozzle, and other such supply apparatuses may be used. It is also possible to use a dip process.

Figure 4:
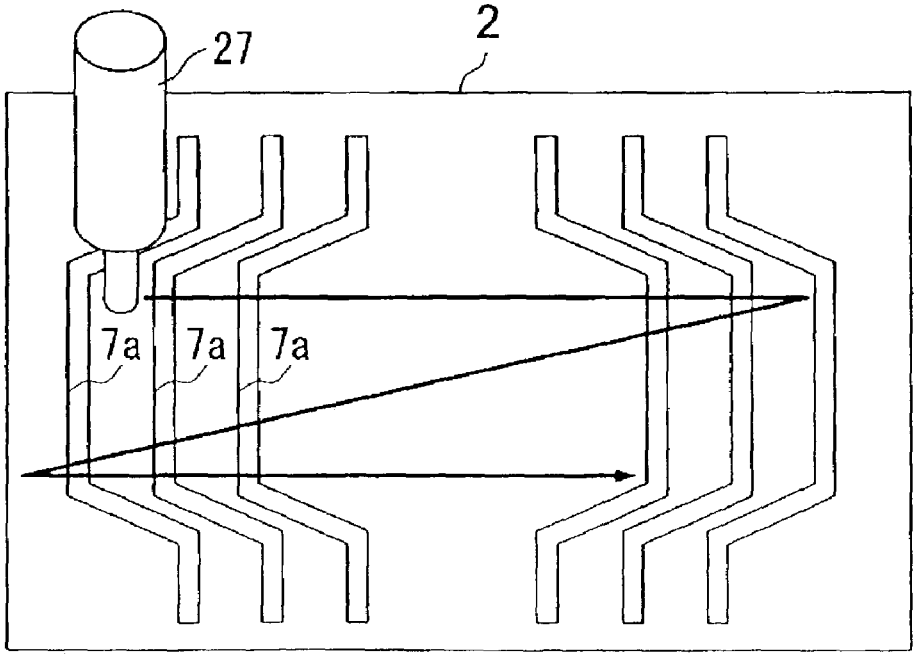
FIG. 4 is a schematic view used to describe a slurry filling process in a manufacturing method of a plasma display panel according to a first embodiment of the present invention.

For the filling process as described above, with reference to FIG. 4, it is preferable that the dispenser 27 (or a similar supply apparatus) is used to fill each of the concave sections 7*a* one at a time. Since the silicon dioxide films 22 are formed on the distal ends of the barrier ribs 8, the slurry 28 is not left remaining on the distal ends of the barrier ribs 8 even when deposited thereon as a result of the repellency of the silicon dioxide film 22.

The slurry 28 is a liquid material that includes at least conductive particles, glass frit, water, a binder resin, and a dispersing agent as described above. It is preferable that the conductive particles are able to combine with the glass frit to be integrally formed with the same following a heat treatment process at a predetermined temperature. For example, silver particles or silver compound particles having an average particle diameter of 0.05~5.0 μm, or preferably 0.1~2.0 μm, may be used.

Further, for the glass flit, a substance that does not affect the characteristics of electrodes should be used. Preferably, the glass frit is fused at a temperature of 420~490° C. borosilicatelead glass, borosilicatezinc glass, or borosilicatebismuth glass having an average particle diameter of 0.1~5.0 μm, or preferably 0.1~2.0 μm, maybe used.

Next, with reference to FIG. 3B, the slurry 28 is kept still for a predetermined time so that the conductive particles and glass frit in the slurry 28 are precipitated. Accordingly, a conductive mixture powder 29, which includes the conductive particles and the glass frit, settles at a bottom portion of the concave sections 7*a*.

After the above, with reference to FIG. 3C, the conductive mixture powder 29 is heat treated at a predetermined temperature and for a predetermined duration such that there are formed the address electrodes 11, which are realized through conductive material of thoroughly combined conductive particles and glass frit. It is preferable that the heat treating process be performed at a temperature of 300~600° C. at atmospheric pressure and for 5~60 minutes.

Figure 5A:
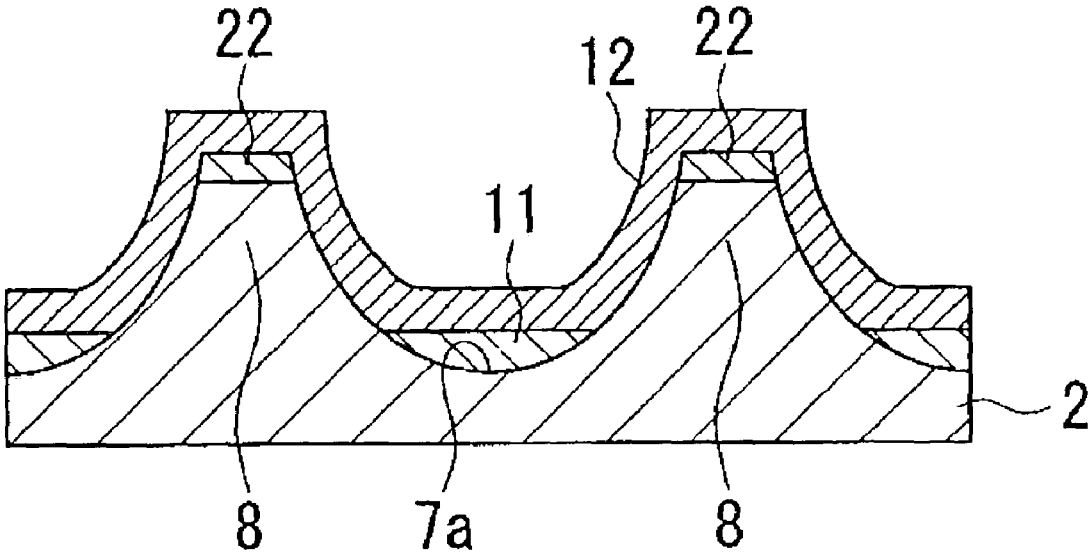
FIGS. 5A and 5B are partial sectional views showing sequential steps in forming dielectric layers and phosphor layers in a manufacturing method of a plasma display panel according to a first embodiment of the present invention.

Next, referring to FIG. 5A, the dielectric layer 12 is formed on the glass substrate 2 covering all elements formed thereon. The dielectric layer 12 may be formed by a growing process such as a sputtering process or a CVD(Chemical Vapor Deposition) process, or may be formed by using dielectric sheets. Dielectric sheets allow for a simpler process to thereby result in reduced overall manufacturing costs.

Figure 5B:
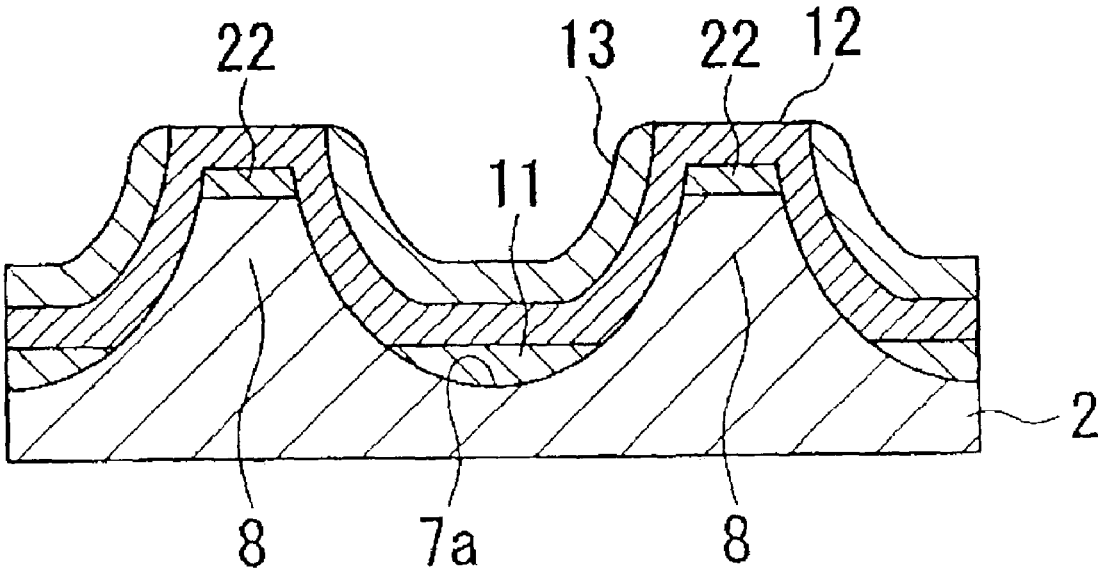

As illustrated in FIG. 5B, a paste phosphor material of red, green, and blue colors is deposited on inner surfaces of the concave sections 7*a* and not on the barrier ribs 8, that is, only on areas of the dielectric layer 12 within the discharge cells 7. Next, drying and sintering are performed to form the phosphor layers 13. The rear glass substrate 2 is therefore formed using the processes as described above.

The front glass substrate 3 is formed by layering, in this order, a plurality of the scanning electrodes 4A and the sustain electrodes 4B made of a transparent conductive material such as ITO and $SnO_2$, the transparent dielectric layer 5, and the transparent protection layer (not illustrated). The scanning electrodes 4A, the sustain electrodes 4B, and the transparent dielectric layer 5 may be formed using the same processes as used to form the address electrodes 11 and the dielectric layer 12, or may be formed by using other processes.

Subsequently, the glass substrates 2 and 3 are provided opposing one another, then in a state where a compound gas such as Ne—Xe and He—Xe is provided in each of the discharge cells 7, the glass substrates 2 and 3 are sealed using a sealant such as sealant glass around peripheries of the opposing surfaces.

In the PDP 1 of the first embodiment of the present invention as described above, the address electrodes 11 that are perpendicular to the scanning electrodes 4A and the sustain electrodes 4B are formed along bottom surfaces of the concave sections 7*a* of the rear glass substrate 2. Also, the address electrodes 11 are formed by filling the concave sections 7*a* with the slurry 28, which includes at least conductive particles, glass frit, water, a binder resin, and a dispersing agent, after which a heat treatment process is performed at a predetermined temperature and for a predetermined duration such that the materials of the conductive mixture powder 29 combine, thereby resulting in the address electrodes 11. As a result, a spacing between the first and second electrodes in plasma generation regions is substantially uniform, resulting in minimal differences in plasma discharge. Hence, display spots in the pixel regions are significantly reduced such that overall display quality is improved.

Further, in the method of manufacturing a PDP according to the first embodiment of the present invention, the dispenser 27 is used to fill concave sections 7*a* with the water-based slurry 28, then this slurry 28 is kept still for a predetermined time so that the conductive mixture powder 29, which is realized through conductive particles and glass frit, in the slurry 28 is precipitated. Next, the conductive mixture powder 29 is heat treated to thereby form the address electrodes 11. Therefore, the method is simplified and the steps involved are reduced to thereby minimize overall manufacturing costs of the PDP 1. Also, simple manufacturing equipment is used in these processes such that overall manufacturing equipment costs are reduced.

Figure 6:
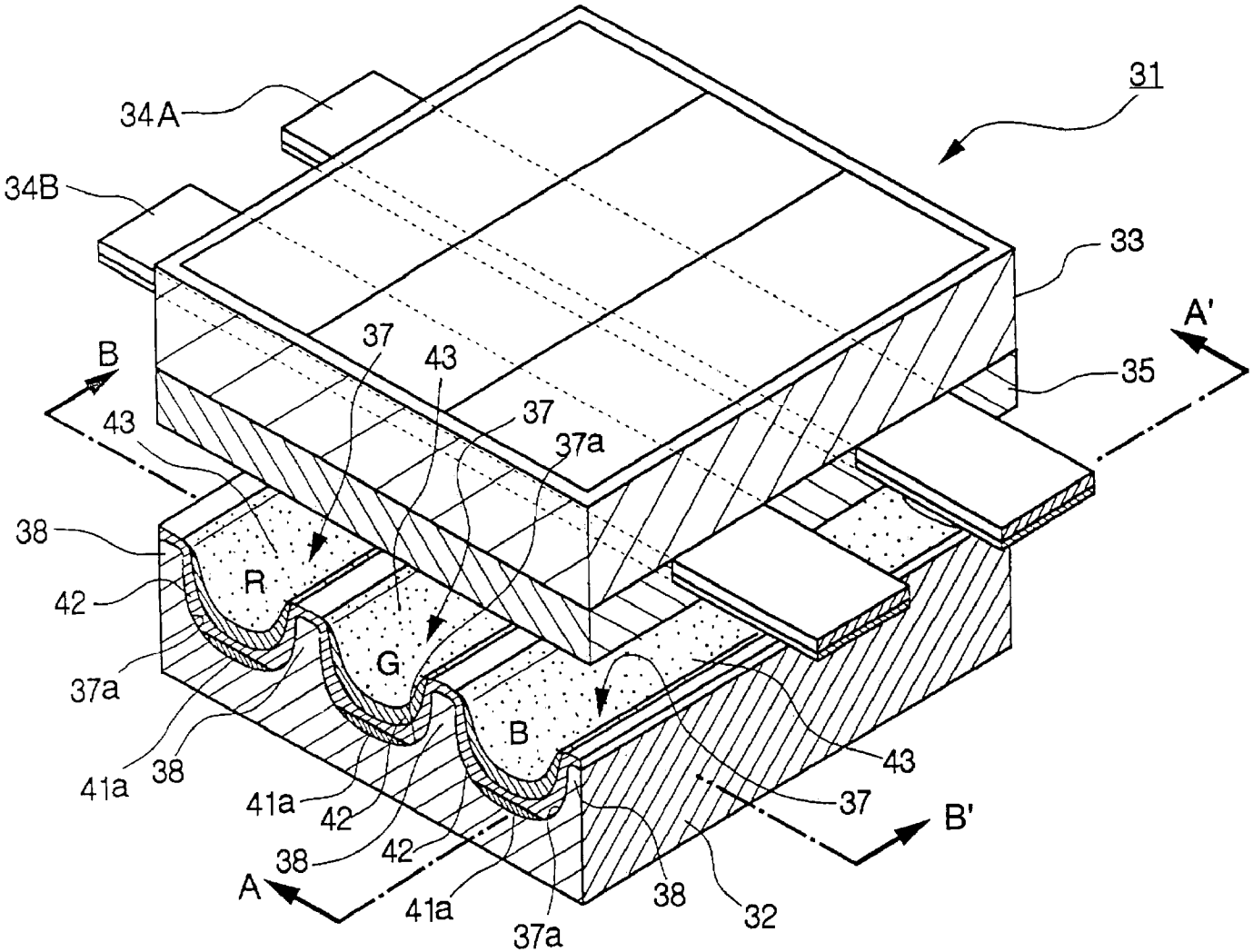
FIG. 6 is a partial exploded perspective view of a plasma display panel according to a second embodiment of the present invention.
Figure 7:
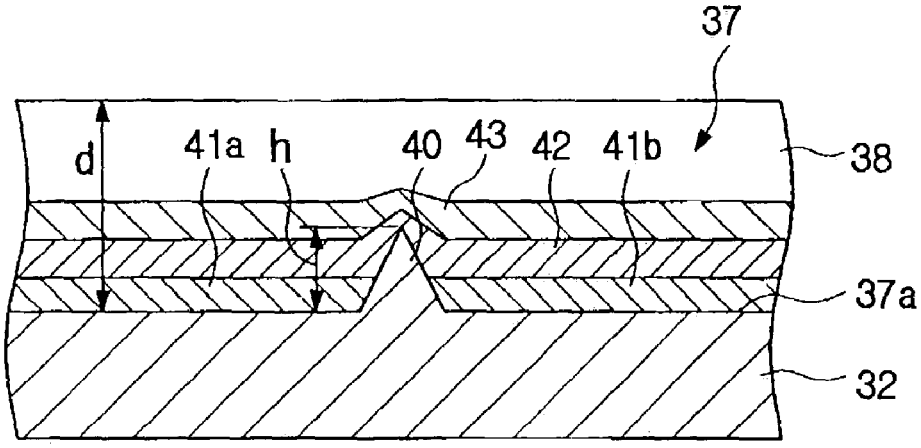
FIG. 7 is a sectional view taken along line A-A of FIG. 6.
Figure 8:
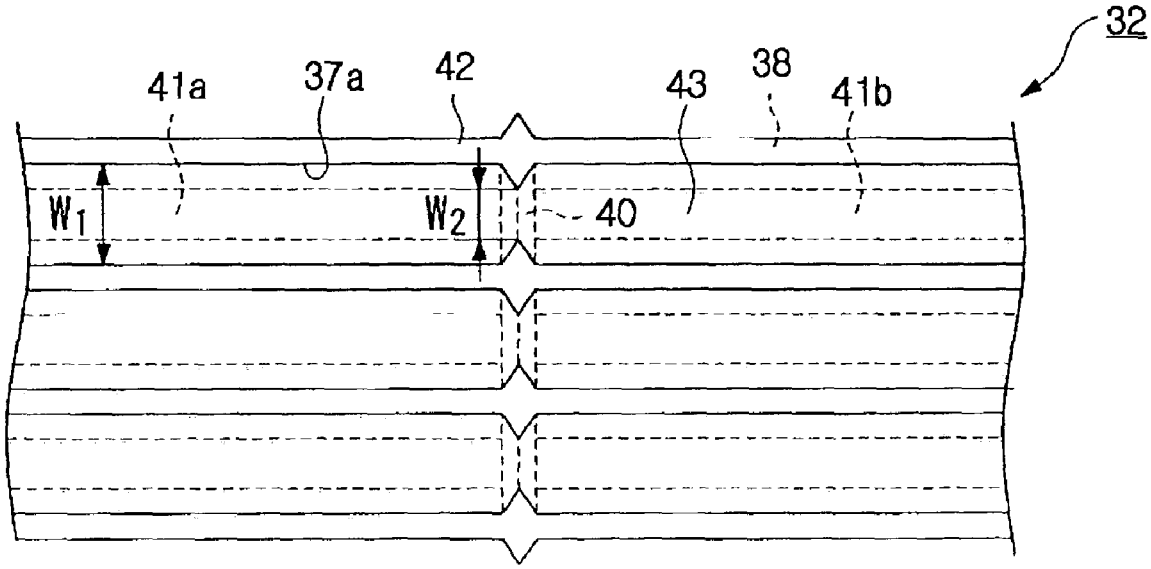
FIG. 8 is a plan view of a rear glass substrate of the plasma display panel of FIG. 6.

FIG. 6 is a partial exploded perspective view of a plasma display panel according to a second embodiment of the present invention, FIG. 7 is a sectional view taken along line A-A' of FIG. 6, and FIG. 8 is a plan view of a rear glass substrate of the plasma display panel of FIG. 6.

Referring to FIG. 6, a plasma display panel (PDP) 31 includes a rear glass substrate 32 and a front glass substrate 33 provided opposing one another to define an exterior of the PDP 31. Scanning electrodes (first electrodes) 34A and sustain electrodes 34B made of a transparent conductive material such as ITO and $SnO_2$ are formed in parallel and in a striped pattern on an inner surface of the front glass substrate 33 facing the rear glass substrate 32. A transparent dielectric layer 35 is formed on the front glass substrate 33 covering the scanning electrodes 34A and the sustain electrodes 34B, and a transparent protection layer (not illustrated) made of a material such as MgO is formed on the front glass substrate 33 covering the dielectric layer 35. The scanning electrodes 34A and the sustain electrodes 34B are provided as described above in an alternating configuration.

Discharge cells 37, inside of which gas discharge occurs, are formed on an inner surface of the rear glass substrate 32 opposing the front glass substrate 33. That is, a plurality of barrier ribs 38 having a predetermined height is formed in a striped pattern along a direction that is orthogonal to the scanning electrodes 34A and the sustain electrodes 34B. Concave sections 37*a* are formed between the barrier ribs 38, and the discharge cells 37 are defined by the concave sections 37*a* and the barrier ribs 38. It is preferable to form the barrier ribs 38 integrally to the rear glass substrate 32 as illustrated in the drawing for ease of manufacture. However, the barrier ribs 38 may be formed as separate units from the rear glass substrate 32.

Referring also to FIGS. 7 and 8, within each of the discharge cells 37, that is, along a bottom of each of the concave sections 37*a* at a center of a length of the same, is formed a triangular protrusion 40 that partitions the concave section 37*a* into two sections. A pair of address electrodes (second electrodes) 41*a* and 41*b* is formed along the bottom of each of the concave sections 37*a*, with one of the pair of the address electrodes 41*a* and 41*b* corresponding to each divided section of the particular concave section 37*a*. Electrode 41*a* is electrically separate from electrode 41*b*. The address electrodes 41*a* and 41*b* perpendicularly intersect the scanning electrodes 34A and the sustain electrodes 34B. A dielectric layers 42 having a high reflexibility is formed covering the address electrodes 41*a* and 41*b*. Further, phosphor layers 43, each made of red, green, or blue phosphors are formed over the dielectric layer 42, that is, one of the phosphor layers 43 is formed over the dielectric layer 42 in each of the concave sections 37*a*. A height (h) of the protrusions 40 is 20~100% a height (d) of the barrier ribs 38.

The address electrodes 41*a* and 41*b* are formed by filling the concave sections 37*a* with a slurry (conductive liquid material), which includes at least conductive particles, glass frit, water, a binder resin, and a dispersing agent. Next, the slurry is kept still for a predetermined time to precipitate the conductive particles in each of the sections of the concave sections 37*a*, then a heat treating process is performed at a predetermined temperature and for a predetermined time such that the precipitated conductive particles join together.

For the conductive particles, silver particles or silver compound particles having an average particle-diameter of 0.05~5.0 μm, or preferably 0.1~2.0 μm, may be used. Further, for the glass flit, a substance that does not affect the characteristics of electrodes should be used. For example, borosilicatelead glass, borosilicatezinc glass, or borosilicate-bismuth glass having an average particle diameter of 0.1~5.0 μm, or preferably 0.1~2.0 μm, is used.

The rear and front glass substrates 32 and 33 structured in this manner are provided opposing one another, then in a state where a compound gas such as Ne—Xe and He—Xe, which use Xe resonance radiation of 147 nm, is provided in each of the discharge cells 37, the rear and front glass substrates 32 and 33 are sealed using a sealant around peripheries of the opposing surfaces.

In the PDP 1 structured as in the above, the scanning electrodes 34A, the sustain electrodes 34B, and one end of the address electrodes 41 a and 41b are protruded outwardly from the glass substrates 32 and 33, and voltages are selectively applied to terminals connected to these elements. Accordingly, discharge occurs in the discharge cells 37 between the scanning electrodes 34A, and the sustain electrodes 34B and the address electrodes 41*a* and 41*b*. By such discharge, excitation light is outwardly emitted (i.e., away from the PDP 31) from the phosphor layers 43.

A method for manufacturing the PDP 31 of the second embodiment of the present invention will now be described. FIGS. 9A to 9F, 10A to 10C, and 11A and 11B are drawings showing sequential steps in manufacturing the PDP 31 according to the second embodiment of the present invention, and are taken along line B-B' of FIG. 6. First, with reference to FIG. 9A, after a glass substrate (transparent substrate) 32, which is made of a substance such as soda lime, is cleaned using an organic solvent then dried, a silicon dioxide film (liquid repellent layer) 52 having repellency (liquid repellency) with respect to the slurry (conductive liquid material) as described above is formed over an entire surface of the glass substrate 32. The silicon dioxide film 52 is formed by depositing an alkoxide such as tetraethylorthosilicate ($Si(OC_2H_5)_4$), then by heat treating the alkoxide at a predetermined temperature.

Figure 9A:
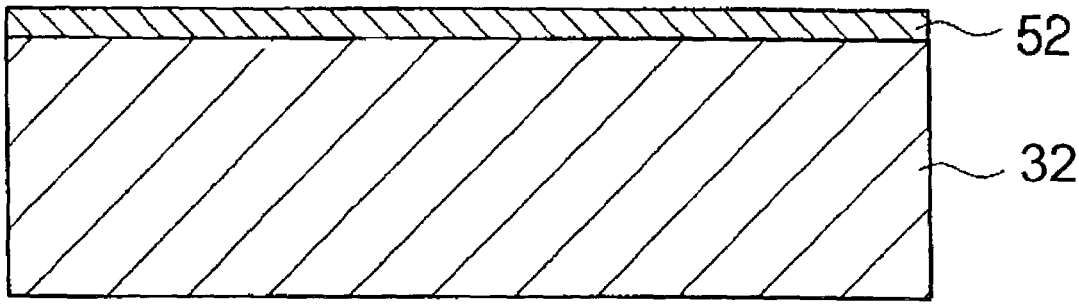
FIGS. 9A to 9F are partial sectional views taken along line B-B of FIG. 6 but showing sequential steps in forming concave sections, which have protrusions, in a manufacturing method of a plasma display panel according to a second embodiment of the present invention.
Figure 9B:
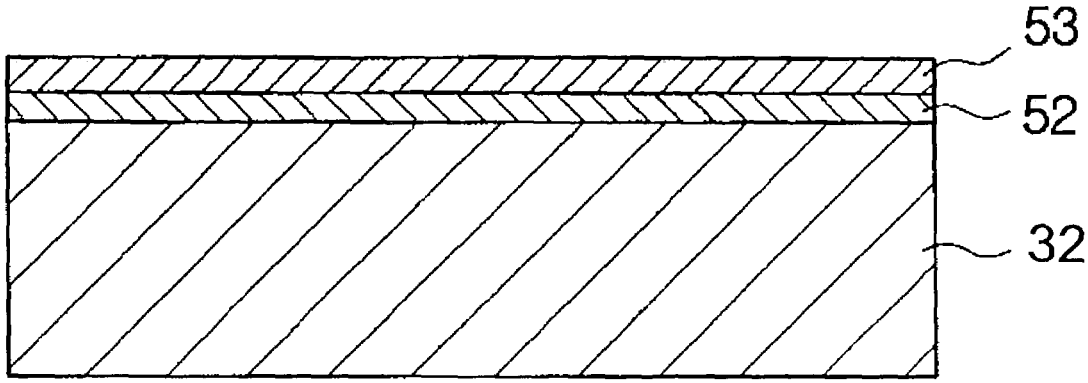

Subsequently, with reference to FIG. 9B, a photoresist 53 (resist film) is formed over an entire surface of the silicon dioxide film 52. A material that is difficult to cut by a sandblasting process is used for the photoresist 53, and it is preferable to use a dry film resist that may be easily formed by a compression process.

Figure 9C:
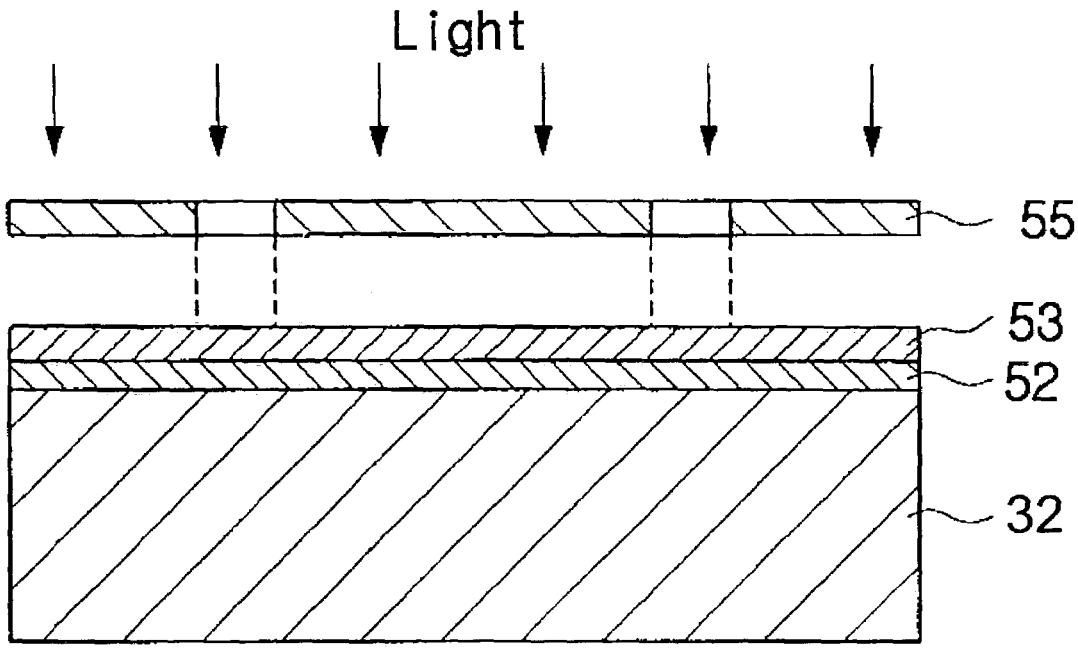
Figure 12:
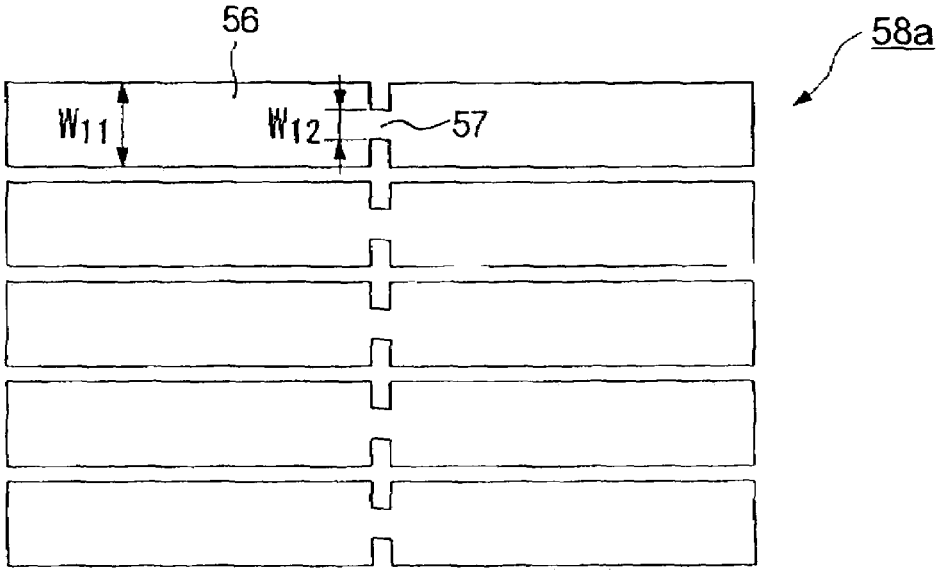
FIG. 12 is a plan view showing a photoresist pattern used in manufacturing a plasma display panel according to a second embodiment of the present invention.

Following the formation of the photoresist 53, with reference to FIG. 9C, a photomask 55 is provided over the photoresist 53 having a pattern corresponding to a shape and location of the barrier ribs 38. The photoresist 53 is then exposed through openings of the photomask 55. Subsequently, with reference to FIGS. 9D and 12, the photoresist 53 is developed to form a pattern 58*a* as illustrated in FIG. 12. Photoresist pattern 58*a* has middle sections 56 or a first gap in the photoresist pattern 58*a* for forming the concave sections 37*a*, and a second and narrower gap 57 in the photoresist pattern 58*a* for forming the protrusions 40.

Figure 9D:
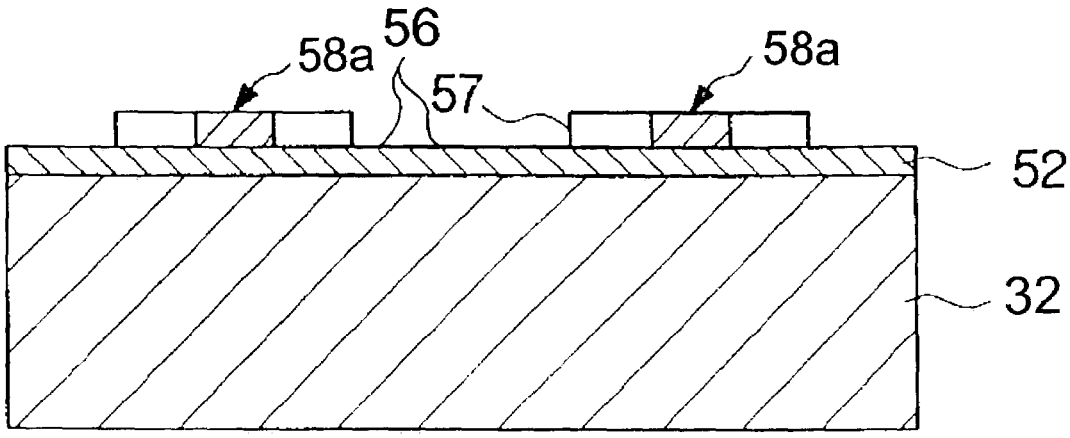

Comparing FIGS. 9D and 12, a photoresist pattern 58*a* is formed where first gap 56 has a width $W_{11}$ and the second and narrower gap 57 has a width $W_{12}$. The size of widths $W_{11}$ and $W_{12}$ in photoresist pattern 58*a* are determined by a chosen width $W_1$ and depth (d) of the concave sections 37*a*, a width $W_2$ and height (h) of the protrusions 40, as well as the conditions of an etching process performed by sandblasting. That is, in the etching process, the width W, of the concave sections 37*a* is determined by the width $W_{11}$ of the middle sections 56 in the developed photoresist pattern 58*a*, and the width $W_2$ of the protrusions 40 is determined by the width $W_{12}$ of the narrow sections 57 in the photoresist pattern 58*a*.

Further, if the conditions for etching by sandblasting are established, the width $W_1$ and depth (d) of the concave sections 37*a* are determined by these conditions and by the width $W_{11}$ of the first gap 56 of developed resist pattern 58*a*, and the width $W_2$ and height (h) of the protrusions 40 are determined by these conditions and the width $W_{12}$ of the second gap 57 in photoresist pattern 58*a*. Accordingly, the width $W_{11}$ of the first gap 56 of the photoresist pattern 58*a* and the width $W_{12}$ of the second and narrower gap 57 are determined by the width $W_1$ and depth (d) of the concave sections 37*a*, by the width $W_2$ and height (h) of the protrusions 40, and by the conditions for etching. Thus, in designing a photomask and a developed photoresist pattern 58*a* for the formation of the concave sections 37*a* and the protrusions 40, the size of the gaps 56 and 57 in the developed photoresist pattern and the sandblasting process used will determine the height (d) and width $W_1$ of the concave sections 37*a* and the height (h) and width $W_2$ of the protrusions 40, respectively. Conversely, if a certain height (d, h) and width ($W_1$, $W_2$) of the concave sections 37*a* and the protrusions 40 respectively are desired, one can design a photomask that will develop a photoresist layer 58*a* with gap sizes 56 and 57 respectively that will achieve the desired results.

Figure 9E:
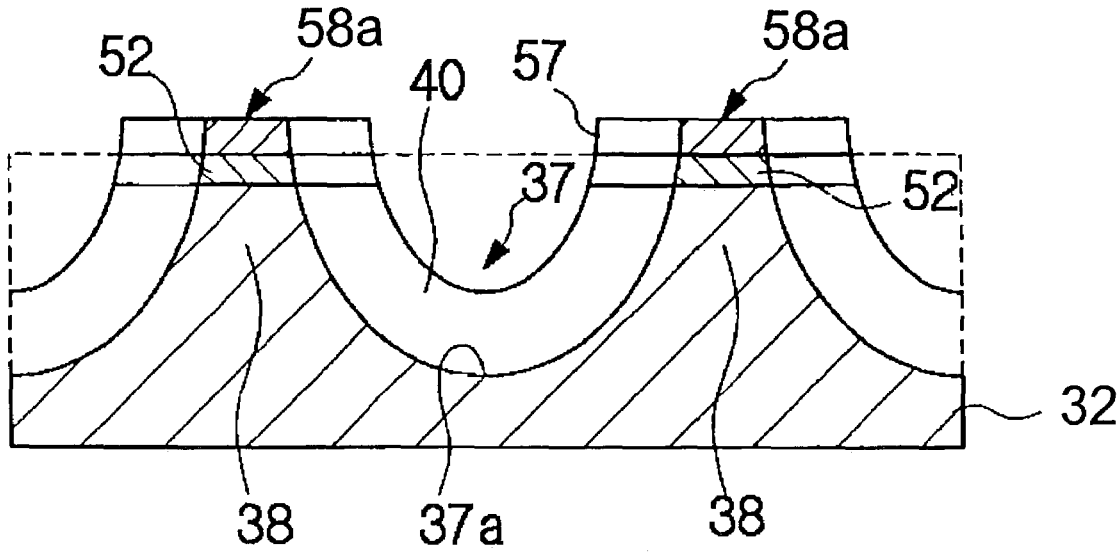
Figure 9F:
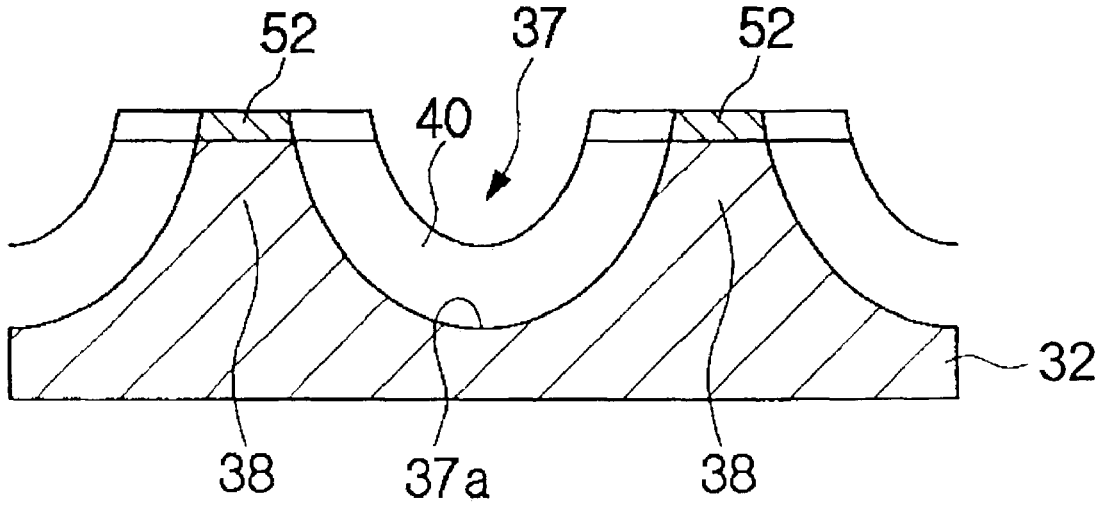

Next, the middle sections or first gap 56 and second gap 57 in the photoresist pattern 58*a*, are etched by sandblasting. Accordingly, the discharge cells 37 defined by the concave sections 37*a* and the barrier ribs 38 are formed as illustrated in FIG. 9E, and, at the same time, the protrusions 40 that divide the concave sections 37*a* into two sections are formed. Since the silicon dioxide film 52 is etched where it is exposed in the middle sections 56 and by the narrow sections 57, the silicon dioxide film 52 is left remaining only on upper surfaces of the barrier ribs 38 after this process is formed.

In the sandblasting process, since the glass substrate 32 is made of a material such as soda lime glass as described above, a silundum (SiC) powder or alumina ($Al_2O_3$) powder, which provide is a sufficient cutting force, is preferably used. To better suit the use of silundum powder or alumina powder, it is preferable that a material that has elasticity even after solidifying be used for the photoresist pattern 58*a*. It is also preferable to use the dry film resist on the basis of the degree of resistance to cutting by sandblasting and adhesivity with respect to the silicon dioxide film 52.

Subsequently, after the photoresist pattern 58*a* is removed and drying is performed, the discharge cells 37 that are defined by the concave sections 37*a* and the barrier ribs 38 are formed, and, at the same time, the protrusions 40 that divide the concave sections 37*a* into two sections are formed. As a result, the glass substrate 32 is therefore formed, in which widths corresponding to the narrow sections 57 are made large.

Figure 10A:
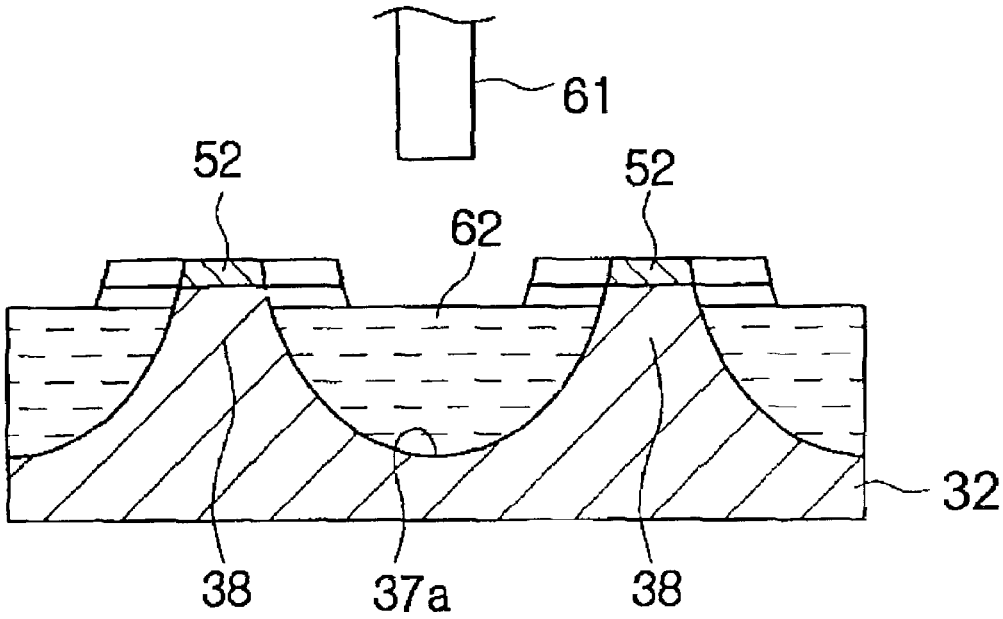
FIGS. 10A to 10C are partial sectional views taken along line B-B of FIG. 6 but showing sequential steps in forming address electrodes in a method of manufacturing a plasma display panel according to a second embodiment of the present invention.

Referring now to FIG. 10A, using a dispenser (supply apparatus) 61, a water-based slurry (conductive liquid material) 62 is filled into the concave sections 37*a* of the glass substrate 32. Instead of the dispenser 61, an inkjet nozzle, spray nozzle, and other such supply apparatuses may be used. It is also possible to use a dip process.

For the filling process as described above, it is preferable that the dispenser 61 (or a similar supply apparatus) is used to fill each of the concave sections 37*a* one at a time. Since the silicon dioxide films 52 are formed on the distal ends of the barrier ribs 38, the slurry 62 is not left remaining on the distal ends of the barrier ribs 38 even when deposited thereon as a result of the repellency of the silicon dioxide film 52.

The slurry 62 is a liquid material that includes at least conductive particles, glass frit, water, a binder resin, and a dispersing agent as described above. It is preferable that the conductive particles are able to combine with the glass frit to be integrally formed with the same following a heat treatment process at a predetermined temperature. For example, silver particles or silver compound particles having an average particle diameter of 0.05~5.0 μm, or preferably 0.1~2.0 μm, may be used.

Further, for the glass frit, a substance that does not affect the characteristics of electrodes should be used. Preferably, the glass frit is fused at a temperature of 420~490° C. borosilicatelead glass, borosilicatezine glass, or borosilicate-bismuth glass having an average particle diameter of 0.1~5.0 μm, or preferably 0.1~2.0 μm, may be used.

Figure 10B:
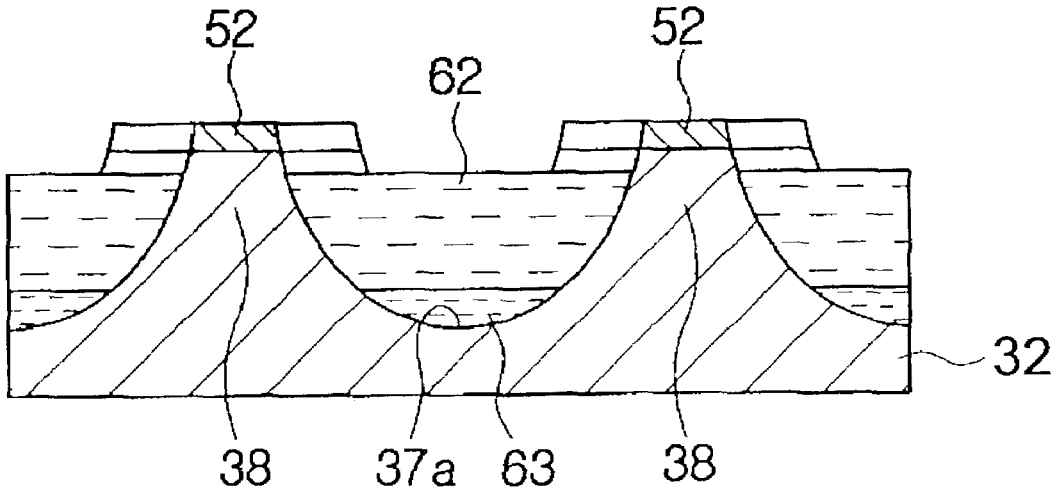

Next, with reference to FIG. 10B, the slurry 62 is kept still for a predetermined time so that the conductive particles and glass flit in the slurry 62 are precipitated. Accordingly, a conductive mixture powder 63, which includes the conductive particles and the glass frit, settles at a bottom portion of the concave sections 37*a*. With the formation of the protrusions 40 that partition the concave sections 37*a* into two sections, the conductive mixture powder 63 precipitated on the protrusions 40 flows down both sides of the same to settle in the two sections of the concave sections 37*a* and is not left remaining on the protrusions 40.

Figure 10C:
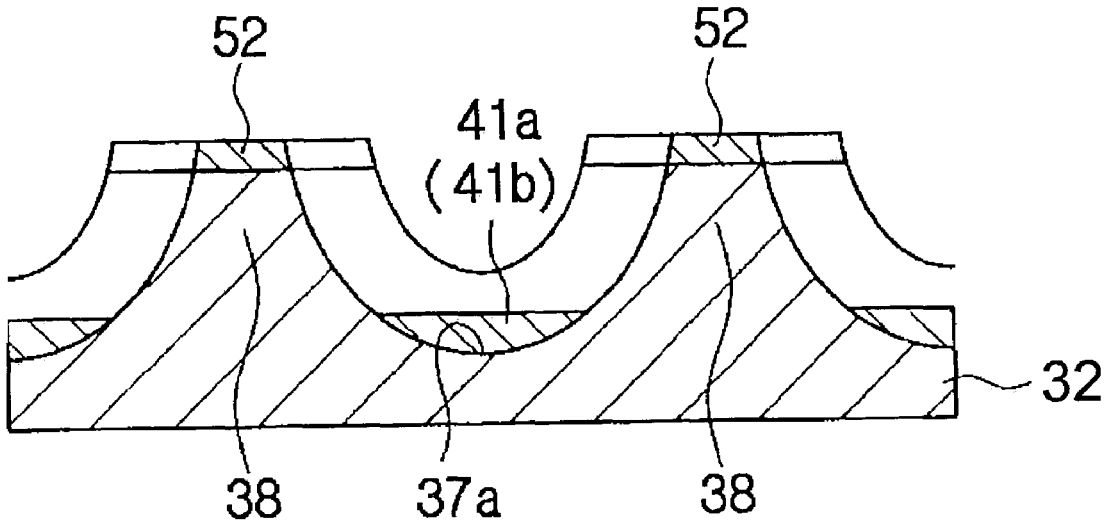

After the above, with reference to FIG. 10C, the conductive mixture powder 63 is heat treated at a predetermined temperature and for a predetermined duration such that there are formed the address electrodes 41*a* and 41*b*, which are realized through conductive material of thoroughly combined conductive particles and glass frit. It is, preferable that the heat treating process be performed at a temperature of 300~600° C. at atmospheric pressure and for 5~60 minutes.

Figure 11A:
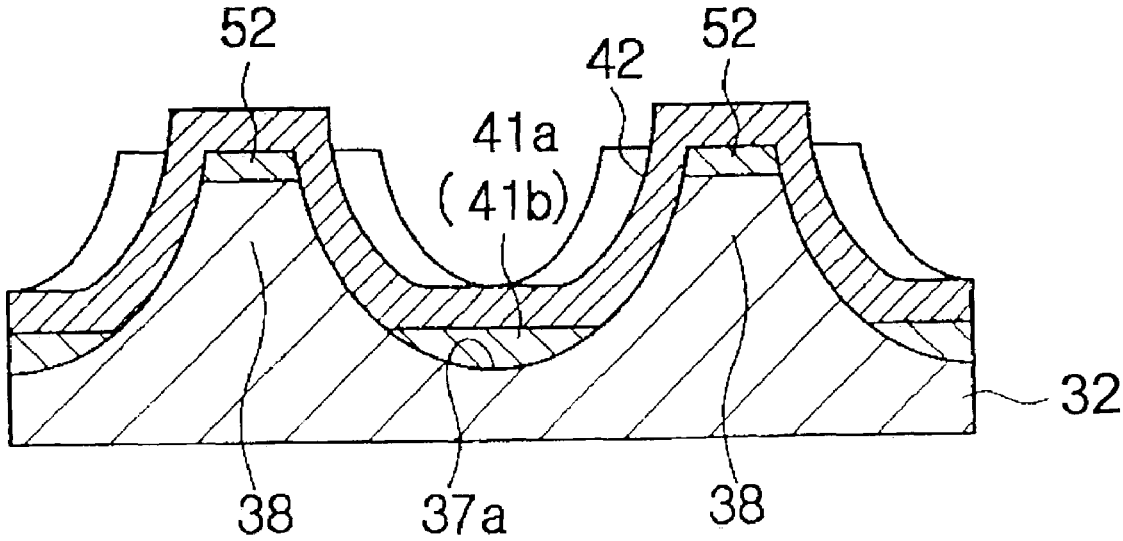
FIGS. 11A and 11B are partial sectional views taken along line B-B of FIG. 6 but showing sequential steps in forming dielectric layers and phosphor layers in a manufacturing method of a plasma display panel according to a second embodiment of the present invention.

Next, referring to FIG. 11A, the dielectric layer 42 is formed on the glass substrate 32 covering all elements formed thereon. The dielectric layer 42 may be formed by a growing process such as a sputtering process or a CVD process, or may be formed by using dielectric sheets. Dielectric sheets allow for a simpler process to thereby result in reduced overall manufacturing costs.

Figure 11B:
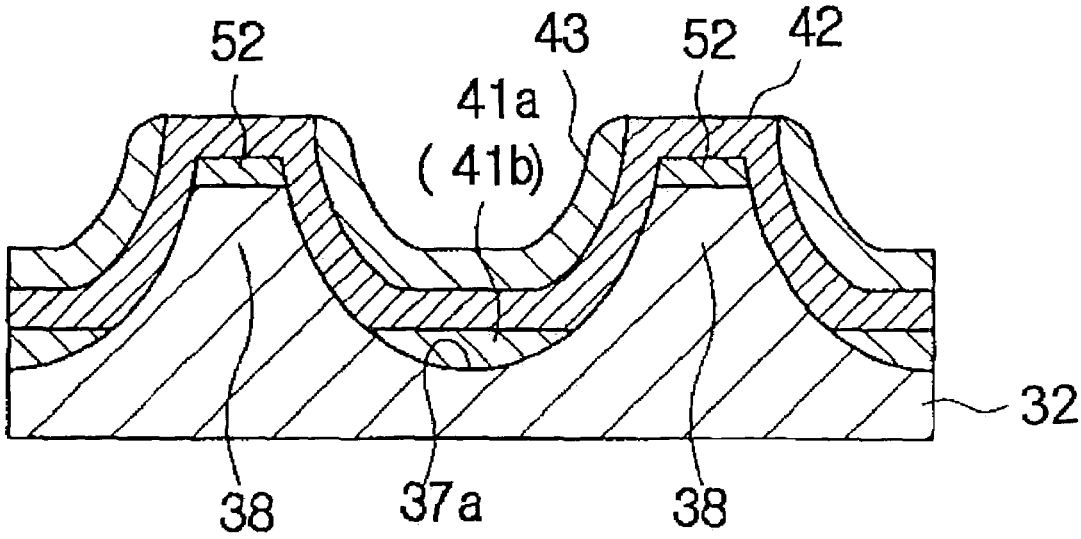

As illustrated in FIG. 11B, a paste phosphor material of red, green, and blue colors is deposited on inner surfaces of the concave sections 37*a* and the barrier ribs 38, that is, on areas of the dielectric layer 42 within the discharge cells 37. Next, drying and sintering are performed to form the phosphor layers 43. The rear glass substrate 32 is therefore formed using the processes as described above.

The front glass substrate 33 is formed by layering, in this order, a plurality of the scanning electrodes 34A and the sustain electrodes 34B made of a transparent conductive material such as ITO and $SnO_2$, the transparent dielectric layer 35, and the transparent protection layer (not illustrated). The scanning electrodes 34A, the sustain electrodes 34B, and the transparent dielectric layer 35 may be formed using the same processes as used to form the address electrodes 41*a* and 41*b* and the dielectric layer 42, or may be formed by using other processes.

Subsequently, the glass substrates 32 and 33 are provided opposing one another. Next, in a state where a compound gas such as Ne—Xe and He—Xe is provided in each of the discharge cells 37, the glass substrates 32 and 33 are sealed using a sealant such as sealant glass around peripheries of the opposing surfaces, thereby completing the manufacture of the PDP 31.

Turning now to FIG. 12, FIG. 12 illustrates a developed photoresist pattern 58*a* that is used in FIGS. 9D and 9E to form the concave portion 37*a* of discharge cell 37 and the protrusions 40 according to the second embodiment of the present invention. Middle section or first gap 56 illustrates an absence of photoresist in a gap having a width $W_{11}$ that is to later become the concave portion 37*a* of discharge cell 37. Also illustrated in FIG. 12 is a narrow section or second gap 57 which is a gap in the photoresist pattern of width $W_{12}$ which is smaller than $W_{11}$. Gap 57 is narrower than gap 56 because protrusion 40 is formed in the vicinity of gap 57. Gap 57 is used to form protrusions 40 in concave regions 37*a*. Glass substrate 32 with photoresist pattern 58*a* on glass substrate 32 is then sandblasted forming concave sections 37*a* where middle section or gap 56 in photoresist was, and protrusions 40 are formed where narrow section or gap 57 in photoresist was. Protrusions 40 have a height (h) from the bottom of concave section 37*a* which is not as tall as concave sections 37*a* having depth (d). Protrusions 40 are automatically formed not as deep as concave sections 37*a* during the sandblasting step because the size of the gap 57 in the photoresist pattern 58*a* is smaller than the size of the gap 56 in the photoresist pattern 59. In this invention, (h) and (d) satisfy the inequality 0.2 (d)≦(h)≦1.0 (d).

Figure 13:
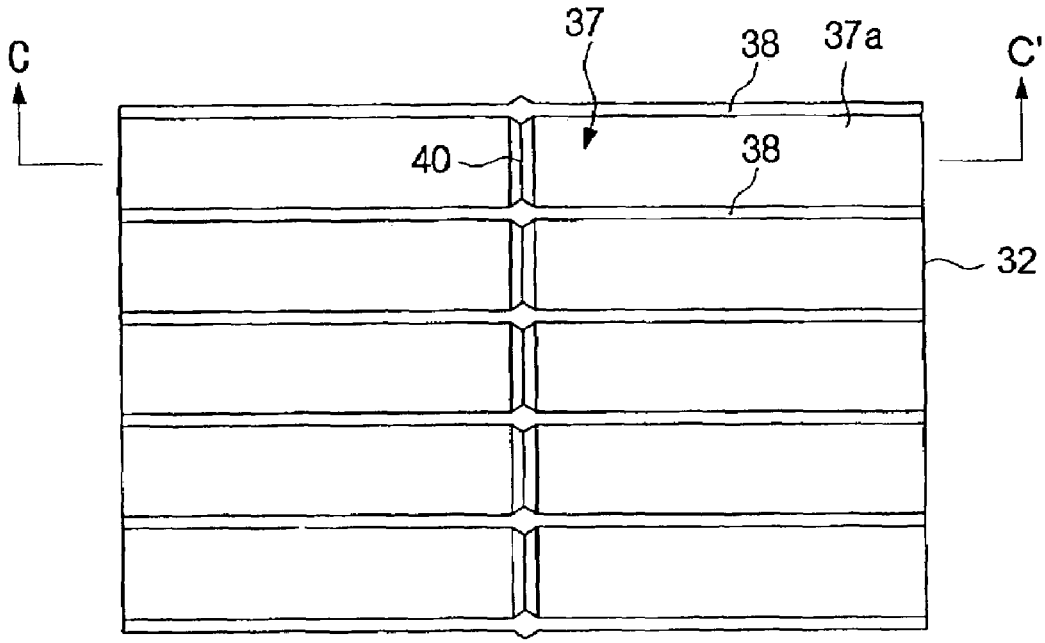
FIG. 13 is a plan view of a glass substrate obtained using a method for manufacturing a plasma display panel according to a second embodiment of the present invention.

Turning now to FIG. 13, FIG. 13 illustrates sandblasted glass substrate 32 (similar to FIG. 9F but from a top view instead of at a side view) after the sandblasting step and after the photoresist removal according to the second embodiment of the present invention. The pattern in glass substrate 32 of FIG. 13 is formed after a sandblasting process on glass substrate 32 covered with photoresist pattern 58*a* of FIG. 12. The resultant glass substrate 32 has a plurality of concave sections 37*a* formed in parallel with each other. Each concave portion 37*a* is separated from adjacent concave portions by barrier rib 38. Within each concave portion 37*a*, an electrode will later be formed and a phosphor layer will be formed to complete the discharge cell 37. Each concave section 37*a* contains within protrusion 40. Protrusion 40 has a height (h) which is 20 to 100% the height (d) of the concave sections 37*a*.

Figure 14:
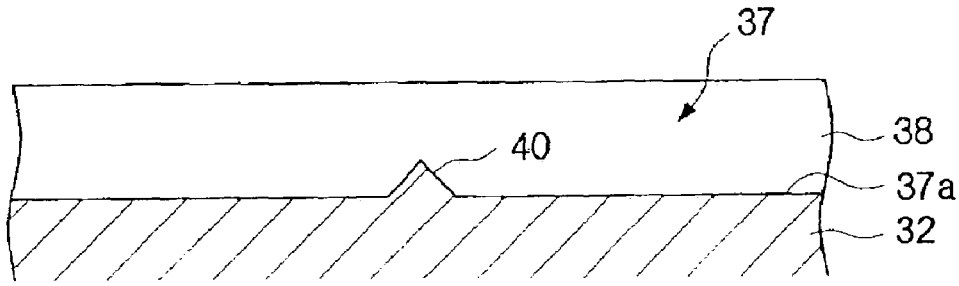
FIG. 14 is a sectional view taken along line C-C of FIG. 13.

FIG. 14 illustrates a sectional view of FIG. 13 taken along line C-C' of FIG. 13. As can be seen, concave section 37*a* is interrupted by protrusion 40 protruding from a bottom of concave section 37*a*. In FIG. 14, the height (h) of protrusion 40 is less than the depth (d) of concave section 37*a*.

Figure 15:
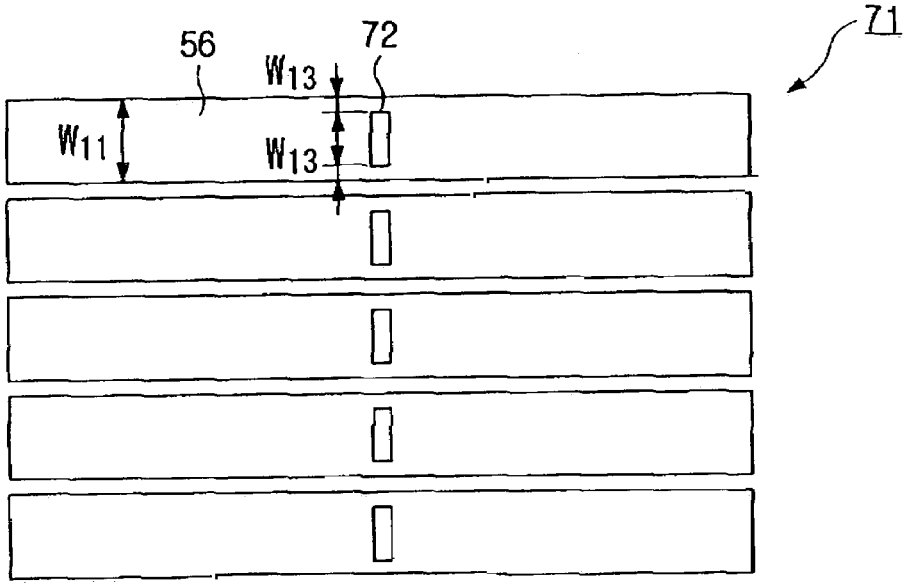
FIG. 15 is a plan view showing a photoresist pattern used in manufacturing a plasma display panel according to a modified example of a second embodiment of the present invention.

FIG. 15 is a plan view illustrating another photoresist (resist film) pattern that can be used in manufacturing the PDP 31 according to a modified example of the second embodiment of the present invention. The developed photoresist pattern (resist film) 71 includes the middle sections 56 for forming the concave sections 37*a*, and a pair of narrow sections 72 for forming the protrusion 40 that divide the concave sections 37*a* into two sections and having a width that is less than the middle sections 56. Narrow sections 72 are islands of photoresist in an area 56 absent of photoresist. In this case also, a width $W_{11}$ of the middle sections 56 and a width $W_{13}$ of the narrow sections 72 are determined by a width $W_1$ and depth (d) of the concave sections 37*a*, a width W2 and height (h) of the protrusions 40, and conditions of an etching process performed by sandblasting.

Figure 16:
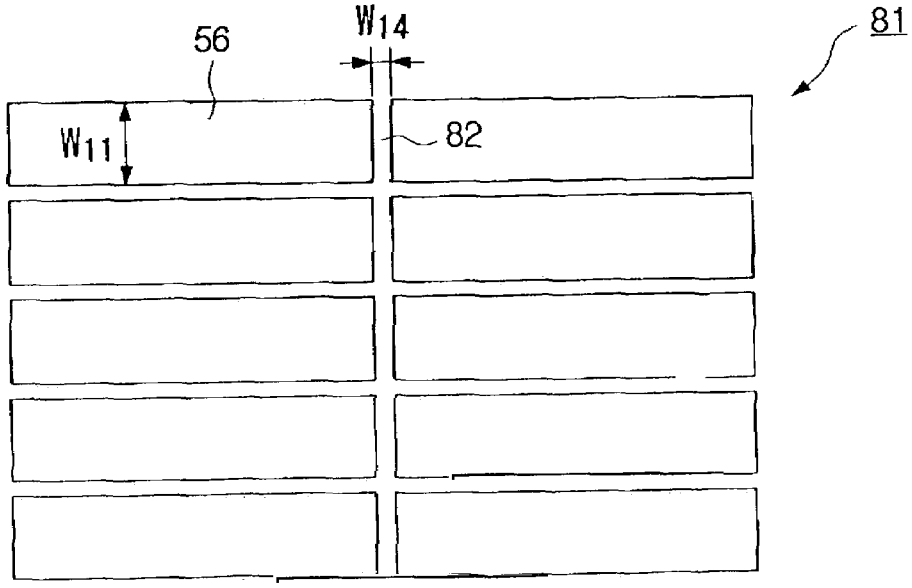
FIG. 16 is a plan view showing a photoresist pattern used in manufacturing a plasma display panel according to another modified example of a second embodiment of the present invention.

FIG. 16 is a plan view illustrating yet another developed photoresist (resist film) pattern 81 that can be used in the manufacturing the PDP 31 according to another modified example of the second embodiment of the present invention. The photoresist (resist film) 81 includes the middle sections 56 for forming the concave sections 37*a*, and a narrow cutoff section 82 for forming the protrusions that divide the concave sections 37*a* into two sections and that divides the photoresist 81 itself into two sections. Sections 56 illustrate an absence of photoresist and sections 82 illustrate a presence of photoresist. As in the examples of FIGS. 12 and 15, a width $W_{11}$ of the middle sections 56 and a width $W_{14}$ of the cutoff section 82 are determined by a width $W_1$ and depth (d) of the concave sections 37*a*, a width $W_2$ and height (h) of the protrusions 40, and conditions of an etching process performed by sandblasting.

With the use of this photoresist 81, the height of the protrusions 40 from a distal end thereof to the bottom of the concave sections 37*a* is made the same the height of the barrier ribs 38 from the distal end thereof to the bottom of the concave sections 37*a*. Accordingly, the concave sections 37*a* are fully divided into the two sections.

In the PDP 31 of the second embodiment of the present invention as described above, the address electrodes 41*a* and 41*b* that are perpendicular to the scanning electrodes 34A and the sustain electrodes 34B are formed along bottom surfaces of the concave sections 37*a* of the rear glass substrate 32. Also, the address electrodes 41*a* and 41*b* are formed by filling the concave sections 37*a* with the slurry 62, which includes at least conductive particles, glass flit, water, a binder resin, and a dispersing agent, after which a heat treatment process is performed at a predetermined temperature and for at predetermined duration such that the materials of the conductive mixture powder 63 combine, thereby resulting in the address electrodes 41*a* and 41*b*. As a result, differences in plasma discharge in the regions of the address electrodes 41*a* and 41*b* are minimized. Hence, display spots in the pixel regions are significantly reduced such that overall display quality is improved.

Further, in the method of manufacturing a PDP according to the second embodiment of the present invention, there is formed the photoresist 58 having the narrow sections 57 for forming the protrusions 40, which divide the concave sections into two sections. This photoresist 58 is used to manufacture the glass substrate 32 that includes the discharge cells 37 defined by the concave sections 37*a* and the barrier ribs 38, and includes the protrusions 40 that partition the concave sections 37*a* into two sections. The water-based slurry 62 is then filled into the concave sections 37*a*, then this slurry 62 is kept still for a predetermined time such that the conductive-particles and the glass frit in the slurry 62 are precipitated. The formed conductive mixture powder 63 is then heat treated to thereby complete the formation of the address electrodes 41*a* and 41*b*. Therefore, the address electrodes 41*a* and 41*b* formed in the two divided regions of the concave sections 37*a* are formed through a simple process such that overall manufacture is performed in less steps to reduce costs. Further, this manufacturing allows for simple manufacturing equipment to be used to further reduce overall manufacturing costs.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

For example, in the second embodiment of the present invention, although the concave sections 37*a* are divided into two sections by the protrusions 40, it is also possible to form a plurality of the protrusions 40 in each of the concave sections 37*a* to divide the same into a plurality of sections.

What is claimed is:

1. A plasma display panel, comprising:

a first and a second transparent substrate opposing one another;

a plurality of first electrodes arranged in parallel and arranged on the first transparent substrate;

a plurality of second electrodes arranged in parallel and arranged on the second transparent substrate, the second electrodes being arranged perpendicular to the first electrodes; and a plurality of concave portions arranged in said second transparent substrate, each concave portion corresponding to a concave surface, wherein corresponding ones of said plurality of second electrodes are arranged at bottoms of corresponding ones of said plurality of concave portions, with ridges arranged between adjacent concave portions, each ridge having a top surface being of a water repellant film.

2. The plasma display panel of claim 1, wherein each second electrode comprises a flat top surface that extends from a first point of each concave surface to a second point of said concave surface, each second electrode comprises a convex bottom surface that mates with an entire portion of said concave surface between said first point and said second point, said convex bottom surface of each second electrode meets with said flat top surface of said second electrode at said first and said second points of said concave surface.

3. The plasma display panel of claim 1, wherein each second electrode comprises a flat top surface that is parallel to said top surface of each ridge, said top surface of each second electrode being bounded by said concave portions.

4. The plasma display panel of claim 1, further comprising phosphor material within said concave portions, said phosphor material being on top of the second electrodes.

5. A method of manufacturing a plasma display panel, comprising:

forming concave sections on a first surface of a transparent substrate;

supplying a conductive liquid material comprising conductive particles to the concave sections;

keeping still the transparent substrate with the conductive liquid material thereon to cause the conductive particles in the conductive liquid material to precipitate to a bottom surface of each concave section; and heating the transparent substrate with the precipitated conductive liquid thereon to form electrically conductive electrodes at the bottom of each concave section from the precipitate at the bottom of each concave section.

6. The method of claim 5, further comprising forming on the first surface of the transparent substrate a liquid repellent layer having liquid repellency with respect to the conductive liquid material, the formation of the liquid repellent layer being performed before forming the concave sections, said liquid repellent material being present between adjacent concave sections after the formation of the concave sections.

7. The method of claim 5, wherein in the process of supplying the conductive liquid material, the conductive liquid material is deposited on the first surface of the transparent substrate to fill the concave sections with the conductive liquid material.

8. The method of claim 5, wherein in the process of supplying the conductive liquid material, a supply apparatus is used to supply the conductive liquid material to fill the concave sections with the conductive liquid material.

9. The method of claim 5, further comprising the step of depositing a phosphor layer within the concave sections on top of the electrically conductive electrodes arranged within the concave sections.

10. A plasma display panel, comprising:

a first and a second transparent substrate facing one another;

a plurality of first electrodes arranged in parallel on the first transparent substrate;

a plurality of second electrodes arranged in parallel on the second transparent substrate, the second electrodes being arranged perpendicular to the first electrodes; and a plurality of concave sections arranged in said second transparent plate, wherein ones of said plurality of second electrodes being arranged at a bottom of corresponding ones of said plurality of concave sections, each concave section having a concave surface, wherein each second electrode having a flat top surface that extends from a first portion of the concave surface to a second portion of the concave surface, each second electrode having a bottom surface that mates with an entire portion of the concave surface between said first portion and said second portion, said bottom surface of each second electrode being convex, said bottom surface of each second electrode joins said top flat surface at said first and said second portions of said concave surface.

11. The plasma display panel of claim 10, further comprising a protrusion protruding upward from a bottom of said concave surface, wherein a first portion of said second electrode being on a first side of said protrusion and a second portion of said second electrode being on a second and opposite side of said protrusion, said first and said second portion of said second electrode being physically and electrically separated from each other by said protrusion.

12. The plasma display panel of claim 11, wherein a height of each protrusion is less than one half of a depth of each concave section.

13. The plasma display panel of claim 11, wherein ridges are arranged between adjacent concave sections, each ridge having a top surface made of a water repellant film.

14. A method of manufacturing a plasma display panel, comprising:

forming and patterning a resist film on a first surface of transparent glass substrate;

forming, simultaneously, concave sections and the protrusions within the concave sections in the first surface of the transparent substrate using the resist film;

supplying a conductive liquid material comprising conductive particles to the concave sections; and maintaining the conductive liquid still to precipitate the conductive particles from the conductive liquid to a bottom of the concave sections arranged in the first surface of the transparent substrate, wherein conductive particles do not form on the protrusions in the concave sections; and heating the precipitated conductive particles to form second electrodes in each of the concave sections, wherein said second electrodes do not form on said protrusions.

15. The method of claim 14, further comprising forming on the first surface of the transparent substrate a liquid repellent layer having repellency with respect to the conductive liquid material, the formation of the liquid repellent layer being performed before forming the resist film, the liquid repellent layer being present in spaces between concave sections after formation of the concave sections and after formation of the protrusions.

16. The method of claim 14, wherein in the process of supplying the conductive liquid material, the conductive liquid material is deposited on the first surface of the transparent substrate to fill the concave sections with the conductive liquid material.

17. The method of claim 14, wherein in the process of supplying the conductive liquid material, a supply apparatus is used to supply the conductive liquid material to fill the concave sections with the conductive liquid material.

18. The method of claim 14, further comprising depositing a phosphor layer in each concave section on top of said second electrodes.

19. The method of claim 5, the plasma display panel comprises:

the transparent substrate being a second transparent substrate;

a first transparent substrate facing the second transparent substrate;

a plurality of first electrodes in parallel arranged on the first transparent substrate;

the electrically conductive electrodes formed from the conductive liquid material being second electrodes in parallel to each other and arranged on the second transparent substrate, the second electrodes being arranged perpendicular to the first electrodes; and the concave sections formed in said second transparent plate, each concave section corresponding to a concave surface, wherein corresponding ones of said plurality of second electrodes are arranged at bottoms of corresponding ones of said plurality of concave sections, with ridges arranged between adjacent concave portions, each ridge having a top surface made of a water repellant film.

20. The plasma display panel of claim 1, the plasma display panel being manufactured by a process comprising:

forming the concave portions on a first surface of the second transparent substrate;

supplying a conductive liquid material comprising conductive particles to the concave portions;

keeping still the second transparent substrate with the conductive liquid material thereon to cause the conductive particles in the conductive liquid material to precipitate to a bottom surface of each concave portion; and heating the second transparent substrate with the precipitated conductive liquid thereon to form the second electrodes at the bottom of each concave portion from the precipitate at the bottom of each concave portion.

21. A plasma display panel, comprising:

a first and a second transparent substrate opposing one another;

a plurality of first electrodes arranged in parallel on the first transparent substrate;

a plurality of second electrodes arranged in parallel on the second transparent substrate, the second electrodes being arranged perpendicular to the first electrodes; and a plurality of concave portions arranged in said second transparent substrate, each concave portion corresponding to a concave surface, wherein corresponding ones of said plurality of second electrodes are arranged at bottoms of corresponding ones of said plurality of concave portions, wherein each of said second electrodes has a convex bottom surface that mates with corresponding ones of said concave surfaces of said second transparent substrate, each of said second electrodes having flat top surfaces that is absent of any curve.

22. The plasma display panel of claim 21, said first transparent substrate having a flat inner surface, the plurality of first electrodes being arranged on said flat inner surface, the flat top surfaces of each of said second electrodes being parallel to said flat inner surface of said first transparent substrate.

23. The plasma display panel of claim 1, the water repellant film comprising silicon dioxide.

* * * * *